US008590225B1

(12) United States Patent
Steel et al.

(10) Patent No.: US 8,590,225 B1
(45) Date of Patent: Nov. 26, 2013

(54) SYSTEM AND METHOD FOR ATTACHING AND QUICK RELEASING A FIRST OBJECT TO AND FROM A SECOND OBJECT

(75) Inventors: Philip Van Horn Steel, Surprise, AZ (US); Paul Lagassey, Vero Beach, FL (US); David Stott, Port St. Lucie, FL (US)

(73) Assignee: Hurricane Safety Systems, LLC, Vero Beach, FL (US)

( * ) Notice: Subject to any disclaimer, the term of this patent is extended or adjusted under 35 U.S.C. 154(b) by 594 days.

(21) Appl. No.: 12/396,469

(22) Filed: Mar. 2, 2009

Related U.S. Application Data

(60) Provisional application No. 61/032,427, filed on Feb. 29, 2008, provisional application No. 61/113,129, filed on Nov. 10, 2008, provisional application No. 61/113,134, filed on Nov. 10, 2008.

(51) Int. Cl.
*E06B 3/26* (2006.01)
*E04B 2/82* (2006.01)

(52) U.S. Cl.
USPC ..... 52/202; 52/127.8; 403/DIG. 4

(58) Field of Classification Search
USPC ..... 52/202, 203, 475, 506.01, 127.7, 127.8; 49/463, 465, 61, 62, 63, 50; 403/359.3, 403/DIG. 4; 285/33; 24/573.11
See application file for complete search history.

(56) References Cited

U.S. PATENT DOCUMENTS

| | | | | |
|---|---|---|---|---|
| 4,371,279 | A * | 2/1983 | Prussen et al. | 403/8 |
| 5,596,849 | A * | 1/1997 | Hill | 52/202 |
| 5,722,206 | A * | 3/1998 | McDonald | 52/202 |
| 5,941,031 | A * | 8/1999 | Fullwood | 52/202 |
| 6,502,355 | B1 * | 1/2003 | Bori | 52/202 |
| 6,532,702 | B1 * | 3/2003 | Scribner | 52/202 |
| 6,974,622 | B2 * | 12/2005 | Wade | 428/182 |
| 7,438,336 | B1 * | 10/2008 | Wolf et al. | 292/341.17 |
| 7,559,715 | B2 * | 7/2009 | Germain et al. | 403/294 |
| 7,578,111 | B2 * | 8/2009 | Hawes | 52/741.1 |
| 7,775,001 | B2 * | 8/2010 | Milliken et al. | 52/202 |
| 7,823,342 | B1 * | 11/2010 | Steel et al. | 52/127.8 |

* cited by examiner

*Primary Examiner* — Joshua J Michener
*Assistant Examiner* — Andrew Triggs
(74) *Attorney, Agent, or Firm* — Steven M. Hoffberg; Ostrolenk Faber LLP

(57) ABSTRACT

Systems and methods for attaching and quick releasing from inside hurricane panels at an opening in a structure are provided, thus facilitating egress. Retaining pins may be located inside a panel, protecting them from potential object strikes, and eliminating the need for drilling additional holes in the panels and permitting manipulation from inside the structure. Human error or misuse is addressed, particularly the binding of pins that result from over tightening of nuts. Industry standard methods for installing hurricane panels may be employed or modestly modified as appropriate, and thus studded angle track, F-Track and direct mount systems utilizing either male or female hardware may be employed. Some of the embodiments can attach and quick release track, wherein the panels attached to the track are released when the track is released.

17 Claims, 17 Drawing Sheets

SYSTEM AND METHOD FOR ATTACHING AND QUICK RELEASING A FIRST OBJECT TO AND FROM A SECOND OBJECT

RELATED APPLICATIONS

The present application claims priority from U.S. Provisional Patent Application 61/032,427 filed on Feb. 29, 2008, expressly incorporated herein by reference, and U.S. Provisional Patent Application 61/113,129, filed on Nov. 10, 2008, expressly incorporated herein by reference, and U.S. Provisional Patent Application 61/113,134 filed on Nov. 10, 2008, expressly incorporated herein by reference.

The present application is related to U.S. patent application Ser. No. 11/852,994, filed Sep. 10, 2007 which claims priority from Provisional Patent Application 60/825,053 filed on Sep. 8, 2006, each of which is expressly incorporated herein by reference.

FIELD OF THE INVENTION

The present invention relates to the field of hurricane shutters, and more particularly to systems and methods for attaching and quick releasing a first object to and from a second object, and in particular to hardware for hurricane panel installation, particularly mounting systems and methods which permit the quick removal of the hurricane panels from the inside of a structure to enable means of emergency egress from a shuttered structure.

BACKGROUND OF THE INVENTION

If a structure is to be occupied when hurricane panels are installed, it is necessary to have at least one opening where the hurricane protection system can be secured and removed from inside the structure to allow egress. If this is not feasible in a particular installation, it may then require that one or more openings be left unprotected. Furthermore, it is preferable, and mandatory in most jurisdictions, to have at least one alternate means of egress from the structure. While other, more expensive hurricane protection systems, such as accordion shutters, can be opened and closed from inside the structure, the low-cost and widely preferred hurricane panels typically can only be attached and removed from outside of the structure.

In recent years, many local governments in hurricane prone regions have mandated in their building codes that all new structures must have hurricane protection. Some coastal counties have further mandated that all structures, new or existing, have hurricane protection installed. Furthermore, most insurance companies either require or offer significant discounts for the installation of hurricane protection. Of the many hurricane protection products available, hurricane shutter panels are the most affordable. With the proliferation of hurricane protection, more people will rely on their hurricane protection. As a result, fewer people will evacuate and more people will stay in their homes during a storm. The incidence of fires during power failures is much higher as a result of the use of lamps and candles. As more people stay in shuttered homes during hurricanes, it is likely that more people will need egress from their homes in an emergency. In fact, many local governments already require emergency egress from at least one opening in every bedroom. One major draw-back of hurricane panels is that they can usually only be installed and removed from the outside of a structure. Other systems for providing hurricane protection such as roll down and accordion shutters, and impact glass, which can be opened and closed from inside a building, are substantially more expensive than hurricane shutter panels.

SUMMARY OF THE INVENTION

In typical installations, hurricane panels are attached from the outside of a structure and are not removable from the inside of the structure. The system provides a means to release the panels from the inside of the structure, thus providing additional means of egress, should the primary means of egress become unusable.

The instant invention solves this problem by facilitating the quick release of hurricane shutter panels from inside a structure. The system works in conjunction with industry standard hurricane hardware and installation methods and provides an affordable solution to creating emergency egress through openings protected by hurricane shutter panels. When mounting hurricane panels, at least one panel or series of panels covering a window or door opening is mounted in a way that allows the panel(s) to be removed from inside the structure. This permits egress from the structure through openings normally blocked when hurricane panels are installed. Typically, only one door opening is the primary means of egress from the structure. Enabling the removal of hurricane protection from the inside of the structure usually involves more expensive hurricane protection products such as accordion shutters.

While it is desirable to have more than one means of egress in case the primary means of egress becomes unusable, many home or business owners choose to use the much more affordable hurricane panel rather than alternate protection systems which typically cost three to five times as much as panels. These constraints may be overcome by providing a hurricane panel mounting and quick release system and method that can be used in conjunction with industry standard installation techniques. The most typical methods for mounting hurricane panels include direct mounting methods such as male or female hardware attached directly to a structure, or track mounting methods such as F-Track, studded angle track and U or H header track, or typically a combination thereof attached to the structure. Various embodiments described herein work with industry standard hardware so as to permit its use with a wide variety of industry standard installation methods without requiring modifications to existing installations or installation methods. The system and method therefore works with standard installation tracks and accessories, as well as existing direct mount systems, and is typically reusable.

Improvements are provided over U.S. patent application Ser. No. 11/852,994 and U.S. Provisional 60/825,053, for example, i) adapting in some of the embodiments the pins, such that the pins are located on the inboard side of the hurricane panels, where they are protected from the elements, thus eliminating the need to have holes in the panels for connecting the pins to an extraction mechanism and allowing access to the pins from inside the structure to facilitate removal should the connection to an extraction mechanism fail;

ii) designs which accommodate the use of a sturdier pin;

iii) a technology for preventing the pins from binding in the event a user over-tightens the wing nuts used to secure the panel(s) to the structure, thus minimizing the potential for failure from user error or misuse; and iv) preventing components from scattering when the panels are removed.

The prior application U.S. patent application Ser. No. 11/852,994 teaches, for example, four embodiments for attaching hurricane panels to a structure. In the prior application, a first embodiment is designed for use with studded angle track, a second embodiment is designed for use with F-Track, a third embodiment is designed for use with direct mount systems that use female mounting hardware, and a fourth embodiment is designed for use with direct mount systems that use male mounting hardware. These four embodiments are not interchangeable between mounting methods, and some of the embodiments depend on the release of components which are located outside of the structure and thus prone to failures which cannot be addressed from within the structure.

It is the object to overcome some of the constraints of the embodiments disclosed in the prior application by locating the release components of the system to the interior, protected side of the panels. Location of the release components to the inside side of the panels enables any system failures to be addressed from inside the structure, where such component are readily accessible, and protects system components from possible damage which may occur during a storm event.

It is another object to enable the use of common parts across multiple means of attaching hurricane shutters to a structure. For example, the quick release bolt assembly and the quick release sleeve assembly can be used across multiple embodiments.

It is a further object is to have assemblies comprising components which can be used across multiple platforms for attaching hurricane panels to a structure, thus making it more suitable for use with existing installations.

It is a further object to provide embodiments which do not require drilling holes or otherwise modifying the hurricane panels.

It is a further object to reduce the number of parts needed across multiple platforms and to maximize the use of off-the-shelf parts wherever possible, thus reducing the cost and complexity.

The benefits hereof include that many of the components are common and can be used with more than one embodiment and means of installation. Therefore, the number of parts are fewer and the embodiments make more use of standardized parts which are readily available off-the-shelf.

Likewise, many of the methods of attachment and release disclosed herein are useful for attaching and releasing both panels and track to and from a structure, and as well can be used in other applications for a attaching and releasing any object to and from another object.

Before going on to describe the systems and methods in detail, it will be beneficial to explain some terminology to facilitate the description. Following this terminology is a brief overview of industry standard terms and a section on references for this terminology and references for sources of industry standard hardware components.

Terminology

Hard Panel—The term "hard panel" refers to the panels which are attached to the structure using conventional means. Hard panels cannot be removed from inside of the structure, and remain attached even after "soft panels" see below) are released.

Soft Panel—The term "soft panel" refers to the panels which are attached to the structure using assemblies, to facilitate quick and easy release and removal of such soft panels from inside the structure.

Hard Track—The term "hard track" refers to a track or section of track which is attached to the structure using conventional means and does not release from the structure with activation. Hard track may be, alternatively attached to a structure together with one of the embodiments, such as a spacer or full length spacer.

Soft Track—The term "soft track" refers to a track or section of track which is attached to the structure using assemblies, therefore facilitating quick and easy release and removal of such soft track from within the structure. When soft track is employed, the panels are attached to the soft track with conventional means, thus no modification to the soft track or means of attaching panels is required. When a soft track is released, the corresponding panels attached to it are also released.

Inboard Side—The "inboard side" of a hard panel is the side that makes contact with and is overlapped by the soft panel.

Outboard Side—The "outboard side" of a hard panel is side opposite the inboard side. The "outboard side" of a soft panel is the side that makes contact with the inboard side of a hard panel, if present, otherwise, is the side closest to the opening perimeter.

Flanged Nut—The term "flanged nut", also known as a "washered hex nut" is a nut with an attached washer. As it applies to standard hurricane hardware, a washered, hex head nut performs the same function as a wing nut, without the wings. Flanged nuts facilitate mounting the inboard side of hard panels to the structure before the soft panels are put in place. The holes at the bottom and top of a typical panel are typically of sufficient diameter to allow clearance for the hex-nut, such that the hex head of the flanged nut will fit through the hole in the outboard side of the soft panel when it is put in place over a hard panel, thus letting the soft panels mate neatly with the hard panels.

Quick Release Bolt Assembly—The components of the quick release bolt assembly as assembled. The quick release bolt assembly is used with the first and seventh embodiment.

Quick Release Sleeve Assembly—The components of the quick release sleeve assembly as assembled. This assembly employs a bolt, such as a standard sidewalk bolt, instead of the headless bolt used by some of the other embodiments, and is used in the second, third and fourth embodiments.

Stepped Quick Release Sleeve Assembly—The components of the stepped quick release sleeve assembly as assembled. This assembly employs a headless stepped bolt that attaches into a female mounting connection, and is used in the fifth and eighth embodiments.

Dual Quick Release Sleeve Assembly—The components of the dual quick release sleeve assembly as assembled. This assembly employs an inner and an outer sleeve. The inner sleeve attaches to the male stud protruding from a wall or track, and is used in the sixth embodiments.

Quick Sleeve—The sleeve of the Quick Release Sleeve Assembly, and the Stepped Quick Release Sleeve Assembly, and the outer sleeve of the Dual Quick Release Sleeve Assembly.

Spacer—Used in some embodiments to provide space between the structure and a panel or track so a pin can be inserted into and released from one of the release assemblies.

Second Spacer—Used in some embodiments to provide snug and even contact between the panel and the mounting surface. This can also be described and referred to as a "shim."

Bar—This refers to the metal bar that is used to secure the soft panels to the hard panels in the second, third and fourth embodiments. This bar can be either flat bar, channel or angle extrusions. It can also vary in thickness. The various embodiments use four different bars, each of which has a specific purpose. The four types of bars are described below.

The bar in the preferred embodiments of the second and third embodiments is a piece of studded angle track with the studs removed. The angle track provides more strength than a flat piece of metal, and the holes left by removing the studs correspond to the points where the panels are attached to the bar.

The bar in the fourth embodiment (described below) is preferably a flat piece of metal providing a low profile, although it could be a section of studded angle track which provides the strength and is readily available off the shelf. If a flat bar is use, the panels fit neatly over this flat bar such that the hard panel(s), if any, can be installed in the normal fashion, and the soft panels can be attached to the bar while remaining close to the structure. If a section of studded angle track is used, both the soft and hard panels can be installed on it.

Inside Bar—The bar used with the second embodiment.

Outside Bar—The bar used with an alternate embodiment to the second embodiment.

Quick Release Bar—The bar used with the third embodiment. This bar uses at least two holes on each end for attaching the bar to the hard panels, and at least one slot in the middle for attaching the soft panel(s) to the bar, although the preferred embodiment has three slots in the middle to accommodate two soft panels. Likewise, more than one can be used at each end for a more secure connection of the bar to the hard panels.

Bar Track—This is the flat bar is used in the fourth embodiment to attach the soft panels. It is mounted to the structure and both hard and soft panels can be attached with it or placed over it. Note that a section of studded angle track with the studs removed at the appropriate connection points can be used for the same purpose.

Hard Track—Track that is attached to a structure and remains attached upon release of soft panels.

Soft Track—Track that is released with attached panels utilizing some embodiments.

Industry Standard Methods of Attaching a Hurricane Panel or Protective Cloth to a Structure Female Hardware—Anchors recessed into a wall with a threaded female opening for receiving a bolt. Examples are machine screw anchors, sidewalk bolts, Sammys®, female Panelmates and female inserts.

Male Hardware—Studs screwed into a wall with the male threaded end protruding for receiving a wing nut. Examples are Tapcon SG™, male Panelmates, Panelmate Plus SS, Panelmate Pro and TVAS Anchors.

H-Header or U-Header/Channel Track—One end of panels, often the top, as installed, typically slide into the channel in these types of track. H-Header or U-Header/Channel track are typically used at one end of an opening (typically the top) with Studded Angle Track, F-Track or Male/Female methods of attachment being used at the other end of the opening (typically the bottom). This is useful for minimizing the number of wing nuts which must be used to attach the hurricane shutter panels thus simplifying and speeding up the installation process. Build out U-Header has an extension which extends the track channel away from the surface of the structure. Build-out H-Header is typically used with openings which require the channel to be spaced away from the wall to clear copings or window sills.

Studded Angle Track—The panels are attached to knurled bolts which are pressed into the track. Studded angle track is typically attached to the wall of the structure or to a step or sidewalk which may abut the structure.

F-Track—The panels are attached utilizing specialized track bolts which slide in and out of the bolt channel in the F-Track, allowing flexibility of panel mounting locations and the track bolts to be removed when not in use. Some installations may use a regular hex nut in place of the specialized track bolts. Wing nuts are typically used to attach the panels to the track bolts. Build-out F-Track has an extension which extends the F-Track channel away from the surface of the structure. Build out F-Track is for use with openings which require the F-Track channel to be spaced away from the wall, for example when the space is necessary to clear a coping or window sill.

REFERENCES

The description refers to numerous conventional hardware components used for installing hurricane shutters. A good reference for these hardware components is found in the All Points Screw, Bolt, & Specialty Co. of Pompano Beach, Fla., Hurricane Hardware Catalog which is publicly available on their website at the following Internet URL:

www.allpointsscrew.com/catalog/hurricaneHardware.pdf, and which is incorporated herein by reference. Some useful references in this catalog are:

Nuts and Bolts:
- Sidewalk Bolts—Page 48
- Washered Wing nuts—Page 51
- Knurled Bolts (for Studded Angle Track)—Page 51
- Track Bolts (for F-Track)—Page 52

Female Methods of Attachment (Anchors Recessed into a Wall with a Threaded Female Opening for Receiving a Bolt):
- Machine Screw Anchors and Sidewalk Bolts—Page 49
- Sammys®—Page 60
- Female Panelmate and Female Insert—Page 61

Male Methods of Attachment (Studs Screwed into a Wall with the Male Threaded End Protruding for Receiving a Wing Nut):
- Tapcon SG™—Page 60
- Male Panelmate, Panelmate Plus SS, Panelmate Pro, TVAS Anchor—Page 61

Likewise, the description herein refers to numerous conventional types of hurricane panel mounting tracks. A good reference for types of tracks used to install hurricane panels is found on the Hurricane Depot, Miami Fla. website which is publicly available on the Internet at URL www.hurricanedepot.com/tracks.htm, and which is incorporated herein by reference. According to this reference, common types of hurricane shutter panel tracks include 2"×2" Studded Angle, H-header (For 2" panels), U-Channel Header, 2"×2" Reverse F-Track, Flat F-track, 2"×2" Reverse Studded Angle, 1" Build-out U-header, 2" Build-out U-header, 3" Build-out U-header, 1" Build-out F-track, 2" Build-out F-track, and 3" Build-out F-track.

Finally, before moving on to describe the various embodiments, it is desirable to discuss the concept of an optional extraction mechanism. While the pin(s) can be removed manually, one pin at a time, an optional extraction mechanism facilitates quick and efficient extraction of at least one and preferably multiple pins in multiple assemblies at one time. If an optional extraction mechanism is used, then the pin(s) are connected to the extraction mechanism directly, or by the use of rings, lanyards, cables chains or any combination thereof, or any other suitable means for connecting the pin(s) to the extraction mechanism. In some installations, a direct connection to the extraction mechanism my not be possible, for example if the top of the pin may be too far below the sill of the opening, and under these conditions other hardware components as described above must be used to facilitate this connection.

Although an extraction mechanism can take many forms, and can be as simple as the use of a pair of pliers being used to grab and extract each pin one at a time, there are certain characteristics that are desirable for an extraction mechanism to be used. While, as illustrated by the foregoing pliers example, this discussion is not intended to be limiting, a general description of a suitable extraction mechanism follows:

i) a handle of a size suitable for grasping by a human hand;
ii) connection points for three or five pins, which correspond to one or two panels of a standard installation;
iii) expandable to accommodate additional panels, so a one panel (three connection points) handle can be adapted to accommodate two panels (five connection points) or three panels (seven connection points) and so on;
iv) sturdy, so as not to fail when extraction forces are applied;
v) employ optional hardware to make the connection between the pins and the connection points on the handle.

In any of the embodiments, when the pins are connected to the extraction mechanism, the extraction mechanism can then be used to extract the pins from multiple assemblies thereby facilitating the quick removal of multiple assemblies and one or more corresponding panels attached therewith.

A first embodiment provides for a "quick release bolt assembly" similar to the one disclosed in the first embodiment of U.S. patent application Ser. No. 11/852,994. As compared to U.S. patent application Ser. No. 11/852,994 a preferred embodiment of the first embodiment uses a bolt with a larger diameter, e.g., "5/16-18 bolt" (thus requiring the corresponding holes to be drilled in the F-Track or the bolt holes in the studded angle track to be enlarged). The use of a larger diameter bolt enables the use of a larger diameter pin, which together withstand greater stresses than the original embodiment. In this embodiment, a pin comprising a quick release pin has a larger diameter single shaft than the hitch pin clip used in a previous application. This single-shaft quick release pin is stronger and preferable to the smaller diameter dual-shaft hitch pin clip disclosed in the prior application.

The quick release bolt assembly of this first embodiment is designed primarily for use with F-Track and with some installations of Studded Angle Track. This quick release bolt assembly may also be used with other embodiments for attaching and releasing both panels and track. The quick release bolt assembly of the first embodiment comprises a headless bolt with a pin hole in one end. Although the entire length of the quick release bolt may be threaded, preferably the end with the pin is not threaded, and at least a portion of the end beyond the pin hole is threaded. The F-Track is attached to the structure, and is modified at each panel attachment point with holes in the top and bottom track sized accommodate a pin, and a hole in the back of the track channel sized to allow the pin end of the quick release bolt to be recessed into the back of the track channel. When a quick release bolt is placed in the F-Track at the appropriate attachment point, a pin is inserted through the top channel of the track, through the hole in the bolt and the hole in the bottom channel of the track to secure said quick release bolt to the F-Track.

The panel can then be attached securely to the structure using a nut, wing nut or preferably a washered wing nut. An optional washer can be placed between the panel and wing nut to evenly distribute the tension of the nut or wing nut on the panel, and to assist in preventing over tightening. When this optional washer is used, a bonded washer (neoprene or other substance bonded to one surface) is preferred, with the bonded end being placed to contact the panel.

When the pin is extracted from a connection point made with a quick release bolt assembly, the panel is released at that connection point, and when all the pins connecting one or more attachment points are extracted the panel(s) is/are released for quick removal. The design of the quick release bolt assembly is similar to the design disclosed in the first and second embodiments of U.S. patent application Ser. No. 11/852,994, with a modification in the size of the bolt, size and type of the pin, and the modification in the means of attachment to the F-Track.

Finally, if desired, a optional hole may be disposed at the threaded end of the quick release bolt to allow for a series of the quick releases bolt assemblies to be attached together, for example with pins and lanyard, so components of the quick release bolt assemblies remain tethered together when the hardware is released; thus preventing the multiple quick bolts from scattering when released.

The quick release bolt may also be used with studded angle track. To use the quick release bolt with studded angle track, the studs in the studded angle track at each attachment point to be used must be removed, and depending on the diameter of the quick release bolts being used, the corresponding openings where the studs are removed may have to be enlarged. To attach a panel, the quick release bolts are placed through the holes in the studded angle track (where the studs were removed) and the pin is passed through the pin hole in the quick release bolt. When the panels are attached, the pin rests on the back of the studded angle track and the quick release bolts are secured in place in the studded angle track. When the pins are extracted, the quick release bolts and corresponding attachment points of the panels are released allowing the panels to be removed.

When this first embodiment is used with studded angle track, it is preferable for the studded angle track to be mounted to the ground adjacent to the opening with the mounting hardware disposed in the unstudded side of the angle. However, if the studded angle track must be mounted to the structure on the studded side of the angle, then spacers must be used at the mounting points to create space for the back of the quick release bolt and pins. Thus, in an existing installation, the installation must be retrofitted to add these spacers.

In the preferred embodiments of the second, third and fourth embodiments, the panels to be removed are attached using a bar together with an adaptation of the sleeve and bolt assembly of the third embodiment of U.S. patent application Ser. No. 11/852,994. This is referred to herein as the "quick release sleeve assembly." The modification from U.S. patent application Ser. No. 11/852,994 is the use of a bolt with a head replaces the headless bolt used in the prior application. These components, as modified herein, are referred to as the "quick release sleeve assembly."

The second embodiment is designed to release one or more panels in installations comprising at least two panels more than the number of panels being released. The preferred embodiment uses a quick release sleeve assembly and a bar to release two center panels in configurations of four or more panels. For example, one panel could be released in a three panel configuration, or three panels could be released in a five panel configuration.

In this second embodiment, a bar is used to attach the panels being released to the two panels on either side which are attached to the structure by conventional means. When the pins in the quick release sleeve assembly are removed and the components are disconnected and removed from the bar and panels, the panels intended to be released can then be removed.

In the preferred embodiment of this second embodiment, the bar remains inside the structure and the panels separate from the bar when the release mechanism is activated.

In an alternate embodiment, the bar is located outside the structure and is detached from the panels adjacent to the ones being released, and remains attached to the panels being released.

A third embodiment utilizes the quick release sleeve assembly and a slotted bar which rotates around one connection point on a hard panel and functions as an arm, which when raised, releases connections to the soft panels, and like the second embodiment, can be used to release one or more panels in installations comprising at least two panels more than the number of panels being released. This third embodiment makes the most use of standardized parts. In its preferred embodiment, it utilizes only one quick release sleeve assembly. The slotted bar of this embodiment is used to attach the panels being released to the adjacent, non-releasing (hard) panels. In the preferred embodiment, at least one quick release sleeve assembly attaches one end of the bar to one panel on one side of the panels being released. The other side of the bar is attached to the panel on the other side of the panels being released with a single bolt and wing nut such that the slotted bar can pivot about the bolt at this point of connection.

In the preferred embodiment of this third embodiment, the center of the bar has three slots which correspond to holes in the two center panels being released, such holes being at points of attachment where the panels being released do not intersect with the adjacent panels. The panels being released are attached to the bar through the slots using bolts and wing nuts to secure the panels to the bar. When the pin is removed from the quick release sleeve assembly and the corresponding sleeve, wing nut, and bolt are removed from the bar and panel, the bar can be raised from that end while pivoting about the other end, thus releasing the connection between the bar and the center panels through said slots.

Two variations of this third embodiment dispense with the quick release sleeve assembly and use a bolt and wing nut for all the attachments, thus relying solely on off-the-shelf parts. In one such variation, the bolt and wing nut at one end of the bar is removed manually, allowing the bar to pivot about the other end for releasing the center panels. In the other variation, an extra slot is place in the bar at one end, allowing the bar to be raised without undoing any components. Other variations of this embodiment include using two bolts at each end of the bar (undoing three to release) or using three quick release sleeve assemblies (undoing three to release).

A fourth embodiment employs the quick release sleeve assembly together with a flat bar which serves as a track, and is referred to herein as the "bar track." The bar track as disclosed herein is a flat bar, for example a ¼' thick (or greater) piece of aluminum or steel. In the preferred embodiment, the bar track is placed just above the sill of a window or door opening and is attached to the structure on either side of the opening, and has holes across its length to correspond to the holes in the panels which are to be installed. The panels slated for attachment and removal with this embodiment are attached to this bar track using quick release sleeve assemblies. This fourth embodiment is preferred for use with small openings having three or fewer panels and does not have the constraint of the second and third embodiments which require panels not slated for removal to be mounted with special hardware. In its preferred embodiment this fourth embodiment enables the release of two panels in a two or three panel installation; however, one, two or three panels can be attached and released with this embodiment. When the pins are removed from the quick release sleeve assemblies, the panels so attached are released.

While the preferred embodiment of this fourth embodiment uses a flat bar for a bar track because of its strength and low profile, a modified section of studded angle track may be used instead. While the studded angle track does not have the low profile of a single sided bar, it provides the strength derived from the angle and has the advantage of being an off-the-shelf component. If a studded angle track is used for this purpose, then the studs at the attachment points to be used must be removed to accommodate the bolt of the quick release sleeve assembly.

The advantages of the second, third and fourth embodiments are that they can be employed universally with almost any method for attaching hurricane shutter panels.

The fifth embodiment employs a "stepped quick release sleeve assembly" which is a variation of the quick release sleeve assembly. This fifth embodiment is designed for use with direct mount installation systems employing female mounting hardware disposed in a structure. Thus the stepped quick release sleeve assembly derives its title from the combination of a stepped bolt and a sleeve.

In the preferred embodiment, the variation is the use of a stepped bolt with a ¼-20 thread on one end, and a 5/16 plain shaft on the other end. This allows the bolt to be connected to typical ¼-20 female hardware for mounting hurricane panels and track, while the increase to a 5/16 diameter permits the use of a larger pin and sleeve, which are more resistant to sheer forces. A spacer is used to create space between the panel and the structure to allow room for the pin between the structure and the panel. Although this spacer can be of any dimension as long as the object of creating space for the pin is achieved, in the preferred embodiment, this spacer is ½" in depth and has one hole across this ½" depth sized to accommodate the sleeve of the stepped quick release sleeve assembly. A second hole cross-bored to the first hole accommodates the pin.

Another improvement introduced to this embodiment is the use of a stepped sleeve with two diameters, the larger diameter being on the first end and the narrower diameter being on the second end.

The stepped quick release sleeve assembly of this fifth embodiment is intended for use in conjunction with female hurricane hardware components permanently mounted to a structure. Such female hardware components include but are not limited to sidewalk anchors, female Panelmates®, Sammys® and similar installation hardware methods where the installation makes use of female hardware to attach the panels or track directly to the structure.

While this fifth embodiment of a stepped quick release assembly is intended to be used to attach and quick release hurricane panels to and from the structure itself, it can also be used for attaching and quick releasing track to and from a structure thereby releasing the track and panels together and having the same effect. Likewise, this embodiment can be used to attach and quick release any second object to and from a first object, for example an emergency escape hatch in a piece of machinery.

It is important to note that while the two and three stepped variations of the stepped quick release sleeve assembly employing a fender washer (or other flat piece of metal) are disclosed in this fifth embodiment for use with female direct mount hardware, this concept of using a shoulder combined with a fender washer (or other flat piece of metal) in two or three steps can be used with any of the sleeve or bolt embodiments. Thus any of the embodiments disclosed herein can be designed to circumvent the potential for failure caused by human error or misuse, more particularly the binding of the pin in the other components caused by over tightening of the hardware by the user.

In the preferred embodiment of this fifth embodiment, the stepped quick release sleeve assembly is used with female hardware such as sidewalk anchors, female Panelmates or SAMMYs for attaching the panels slated for quick release. This fifth embodiment takes the place of conventional sidewalk bolts which are typically used to attach panels with female direct mount hardware.

Spacers are utilized to create space between the panel and the structure to make room for the pin. The modification made from the quick release sleeve assembly (used with the second, third and fourth embodiment and that disclosed in U.S. patent application Ser. No. 11/852,994) is the use of a stepped bolt in place of the headed bolt used in said quick release sleeve assembly. The addition of a spacer between the panel and the structure provides sufficient space between said panel and structure so that a pin placed into the sleeve and bolt from between the panel and the structure. This spacer is necessary to make room for the pin, because without it the pin would become wedged between the panel and the wall rendering the assembly non-functional. The use of this spacer thus enables the pin to be relocated to the inboard side of the structure where it is accessible from inside of the opening and is therefore removable from inside of the structure.

The stepped bolt is threaded on one end to match the thread in the female sidewalk or other anchor, and stepped up at the distal end which is unthreaded in the preferred embodiment, but may be unthreaded as well without affecting the intended functionality. The smaller threaded end allows the assembly to be used with existing industry standard female direct mount hardware, and the increased bolt diameter on the distal end enables the use of cross-bored holes sufficient in diameter to accommodate a larger diameter quick release pin in place of the smaller gage hitch pin clip used in U.S. patent application Ser. No. 11/852,994. This quick release pin provides a much sturdier connection for the components which is much less likely to become distorted in the event of an object strike on the panel or mounting hardware during a storm event.

A spacer is made of a material of sufficient strength to support the pressure of the panel pressing it against the wall of the structure without collapsing, and of sufficient depth so as to provide room for the pin between the panel and the wall of the structure and to prevent the pin from being wedged between the panel and the structure. Said spacer has a hole running through its depth, said hole being sized to accommodate one end of the sleeve. When installed, this spacer fits over the stepped bolt and sleeve, and rests between the panel and structure. The pin passes through a cross-bored hole in the spacer and through the stepped bolt and sleeve, thus engaging the sleeve in place.

A threaded sleeve has an inside diameter (preferably unthreaded) which is sufficient so that it can be placed over the distal end of the stepped bolt, and has a pin hole corresponding to the pin in the stepped bolt. The thread on the sleeve corresponds to the thread on a nut, preferably a wing nut. Variations of this sleeve may have two or three steps of diameter as discussed below.

In a two stepped variation, the first end of the sleeve has the wider diameter, said diameter being is sized such that the sleeve can be disposed in the spacer leaving a portion of said first end to protrude beyond the surface of said spacer thus creating a shoulder. This first end of the sleeve need not be threaded. The second end of the sleeve is threaded corresponding to the thread on a wing nut just as the single stepped sleeve. A flat piece of metal, preferably a fender washer has a hole sized to fit over the second end of the sleeve yet of a smaller diameter than the first end of the sleeve, thus resting on the shoulder of the first end of the sleeve when put in place.

While a two stepped variation is desirable, the preferred embodiment employs a three stepped sleeve. The steps on either end of the sleeve are the same as in the two-stepped variation described above. The center step is of a diameter between the steps on either end, and is preferably the same depth as the thickness of the fender washer (or other flat piece of metal). The diameter of the hole in said fender washer (or other flat piece of metal) is sized such that it can be pressed onto said center step. This three stepped sleeve design minimizes the risk of failure caused by human error or misuse, namely over tightening of the nut or wing nut that secures the panel in place, and further by preventing the fender washer from being omitted or installed in the improper sequence. Thus, a three-stepped stepped quick release sleeve assembly is the preferred embodiment of this fifth embodiment.

It should be recognized that while the three stepped sleeve combined with a fender washer (or other flat piece of metal) is the preferred embodiment, and the two stepped sleeve and fender washer variation is also suitable, the concept of this design does not necessarily require the use of a fender washer. If the diameter of the first large end of the sleeve is sufficiently larger than the diameter of the mounting holes on the panel, then the shoulder of this first end may be used for the same purpose. The reason the use of the fender washer is preferred is that it provides a larger surface to support the panel, thereby enabling the use of a lesser diameter sleeve. Without the fender washer the larger diameter end of the sleeve must be significantly larger than that used in the preferred embodiment. In mass production, the design of the two and three stepped sleeve and fender washer combination will result in substantial cost savings on material, as less material will be needed to manufacture the sleeves. Further, the sleeves will weigh less and result in a corresponding reduction in delivery costs to the distribution points.

As with the quick release bolt, if desired, an optional hole on one end of the threaded sleeve may be added to allow a series of the stepped quick release sleeve assemblies to be attached together, for example with pins and lanyard, so components of multiple stepped quick release sleeve assemblies do not scatter and stay together when the panels are released. If a two or three stepped sleeve as discussed above is used, this optional hole is not necessary as the sleeves are attached to the panel(s) between the fender washer and wing nut, and will not scatter in these embodiments.

Referring now to the preferred embodiment which uses a three stepped sleeve, when in use, the threaded end of the stepped bolt is turned into the female hardware already disposed in the wall of the structure. The sleeve and spacer are put in place over the stepped bolt and the three components are connected together by a pin. When the panel is put in place, the inboard side of the panel rests on the fender washer which is pressed onto the center step of the sleeve. A nut, preferably a wing nut, with a thread matching the thread on the distal end of the sleeve is used to attach the panel. If desired, an optional washer can be placed between the panel and nut or wing nut to evenly distribute the tension of the nut or wing nut on the panel, and to assist in preventing over tightening. When this optional washer is used, a bonded washer (neoprene or other substance bonded to one surface) is preferred, with the bonded end being placed to contact the panel.

When the panels are securely attached with the stepped quick release sleeve assemblies, extracting the pins releases the sleeves and frees panels so attached for removal.

In an alternate embodiment of the stepped quick release sleeve assembly, the hole for the pin can be moved away from the threaded end of the bolt (or a second hole can be added) thus enabling the stepped quick release sleeve assembly to be used without a spacer for attaching and releasing track (particularly studded angle track) to and from a structure. This variation is discussed further below.

In a variation of this fifth embodiment, the stepped quick release sleeve assembly is used to attach and release track, and the panels are released together with the track when the track is released. In this variation, use of spacers is not required because the stepped quick release sleeve assemblies are located on the track, in the space between the ridges of the attachment points of the panels, where there is room for attaching and releasing the pins.

By changing the placement of the hole in the stepped bolt of the stepped quick release sleeve assembly, or by adding a second hole, the stepped quick release sleeve assembly can be used to attach track in place of panels. Typically, when used to attach track, the stepped quick release sleeve assembly does not require a spacer. Note that this eighth embodiment when used to attach and release track can be utilized only with installations where the entire track at an opening and all the panels attached to it are being removed. This variation cannot be used in conjunction with a combination of hard and soft panels. In the preferred embodiment of this eighth embodiment, female wall anchors accept the headless bolt of the stepped quick release sleeve assembly. This headless bolt is cross-bored distally to the threaded end, which is inserted into the wall anchor. The track is then secured to the wall utilizing the threaded sleeve, pin and nut (typically a wing nut) assembly, with the use of an optional washer if desired. Although the pin in each such assembly can be extracted directly, in the preferred embodiment the pin is attached to an extraction mechanism on the inside side of the panel, and when the pin(s) is/are extracted, the track is released from the wall, thereby also releasing any panels attached to this track for removal. This embodiment is particularly useful with F-Track and studded angle track, and does not require any modification to the track or the panel(s). Ideally this embodiment is used on short sections of track attaching one to three panels. Although it can be used with longer sections of track, it is also possible to cut a longer track into two sections, and use this embodiment on one section of track which corresponds only to the panel(s) slated for removal from the inside of the structure.

Likewise, the bolt and sleeve assembly of the third embodiment of U.S. patent application Ser. No. 11/852,994 can be utilized to attach and release an entire section of track. In such an application, a bolt and sleeve assembly is used to secure the track to the structure utilizing hardware components of the third embodiment of the prior application. In this variation of this installation method the headless bolt of the third embodiment of the prior application is cross-bored to accept a pin at one end, is inserted into a female wall anchor such that the bolt protrudes from the structure sufficient length to secure any variety of hurricane track to the structure utilizing a pin and optional washer. The track is then secured to the wall by tightening the headless bolt, which optionally my have a square or hexagonal head of same diameter as the bolt to facilitate tightening, with the pin inserted and the optional washer in place until the track is held securely to the structure by the pin and optional washer. When the pin(s) holding the track to the structure is/are extracted, the track is released from the structure, together with the corresponding panels attached to the track. Likewise, this embodiment is particularly useful with F-Track and studded angle track. It is most useful on short sections of track, attached to one to three panels, and has similar advantages to the foregoing embodiment that utilizes the additional sleeve and nut.

A sixth embodiment is intended for use with male hardware components mounted in a structure for attaching hurricane panels to a structure. This embodiment employs a "dual quick release sleeve assembly" to attach and release panels. Such male hardware components include but are not limited to wall mounted studs, male Panelmates, similar installation methods where the male members of the conventional means of attachment protrude from the wall and washered wing nuts are used to attach the panels directly to the male components. This embodiment can also be used with studded angle track where the back of the track is flush to the wall of the structure thus leaving no room for the bolt and pin of the first embodiment.

The preferred embodiment of this sixth embodiment utilizes a dual quick release sleeve assembly for use with direct mount male hardware components. This term dual quick release sleeve assembly is used because this embodiment employs two sleeves.

A first sleeve has a first end with an inside diameter having thread corresponding in size and depth to the male hardware component to which it is to be attached, although the inside diameter and thread may continue beyond that point. Further, this first sleeve has a tab protruding from the outside diameter of the first end, the length of said tab corresponding approximately with the depth of a sleeve (described below) and having a hole in said tab sized for accommodating a pin. The second end of the first sleeve is round with a smooth outside diameter, and preferable solid; although in variations, the outside diameter may be threaded and the inside diameter may be hollow, as a continuation of the inside diameter of the first end.

A second sleeve, also with at least one tab at a first end with a pin hole, both of said at least one tab and pin hole corresponding to the tab and pin hole on the first sleeve. This second sleeve further has an inside diameter sized to accommodate the first sleeve, and a slot in the first end sized to accommodate the slot in the first sleeve; such that the second sleeve can be placed over the first sleeve.

A spacer with a U-channel on one side is used to create space between the panel and the structure for the pin that is used to connect the second sleeve to the first sleeve. This spacer has a cross-bored hole at a 90 degree angle to the U-channel, said cross-bored hole sized to accommodate the pin, and passing through the U-channel at a point where it aligns with the pin holes in the tabs on the first and second sleeves.

When assembled, the first end of the first sleeve is threaded onto the male hardware component as close as possible to the structure while leaving the tab on the first end horizontal to the adjacent surface of the opening in the structure. The second sleeve and spacer are put in place and connected to the first sleeve with the pin. The panel is then placed over the assembly as secured in place with a nut or wing nut. If desired, an optional washer can be placed between the panel and nut or wing nut to evenly distribute the tension of the nut or wing nut on the panel, and to assist in preventing over tightening. When this optional washer is used, a bonded washer (neoprene or other substance bonded to one surface) is preferred, with the bonded end being placed to contact the panel. When the panels are attached and the pins are removed, the second sleeve is released from the first sleeve thereby releasing the panels.

A variation of this sixth embodiment is an earlier design in which the pin is disposed in the two sleeves at an angle, and at a point beyond the distal end of the male hardware component. The pin is connected to a shaft and the shaft passes through the panel, so the pin can be removed from inside the structure. Optionally, the first and second sleeves may also have at least one additional corresponding hole to accommodate a second pin, which second pin may be utilized to hold the assembly in place while the panel is being attached and the first pin is being inserted. If used, this optional second pin must be removed after the panel is attached and the first pin is inserted. While this variation of the sixth embodiment uses sleeves without tabs (which are less costly and difficult to produce), and does not require the use of a spacer, the pin is disposed on the outboard side of the panels and is exposed to potential object strikes during a storm event. Hence, although disclosed, this variation is not preferred.

In an alternate embodiment, a sleeveless system employs a bolt, washer and pin to achieve the purpose of securing a track or a panel to a structure. The bolt with a first pin hole and a second pin hole is partially threaded into the female mounting hardware, and the panel is place over the bolt. A washer is placed over the bolt and panel, and the first pin is inserted to capture the washer on the bolt. The second pin is inserted and used to turn the bolt until the first pin and washer capture the panel securely. The second pin is then removed and the assembly is enabled to quick release the panel. When the first pin is extracted, the washer and panel are freed, and either the track (together with the panel(s) attached to the track) or the panel(s) are released from the structure.

In an eighth embodiment, a car disposed internally to the F-Track channel and actuator connected to the F-Track are used in combination to attach and release the panel, with the panel attached by a nut to a bolt. The bolt is attached by a pin to the internal car disposed with a male track which slides inside the F-Track channel. An actuator, also mounted in the track, is used to redirect the vertical force on a lanyard attached to a handle to a horizontal force, to extract the pin from the car, thereby releasing the bolt. In another variation, the release is not dependent on a pin, and the actuator releases the bolt directly. An optional set screw may be used to hold the internal car in place within the F-Track channel.

In general, the preferred use is with installations that utilize a track or direct mount hardware at the bottom of an opening, and H-Header or U-Channel track (or similar) at the top of an opening, or build out variations of these track types. The use of the system at the bottom of an opening and H-Header or U-Channel track at the top of the opening is the preferred combination of installation hardware, particularly in new installations. However, the same configuration of hardware and track can be used on either side of an opening. Likewise, the system can be used on both ends of a panel, for example in existing direct mount systems that have male or female hardware already installed in the structure at both ends on an opening.

The first embodiment is the preferred means for use with F-Track and for studded angle track in installations where the track is attached to the ground and the back of the track is exposed to the opening with enough clearance between the track and structure to enable the pins to be inserted into the bolts. In the case of studded angle track where it is attached directly to a structure, spacers can be utilized between the studded angle track and the structure in order to create space for the pin between the track and the structure.

The second, third and fourth embodiments can be used in conjunction with various means of attaching hurricane shutter panels to a structure, including but not limited to studded angle track, F-Track, male Panelmates (or other type of wall mounted studs) and female Panelmates or sidewalk anchors. Thus the second, third and fourth embodiments provide a universal means for the attachment and quick release of hurricane shutter panels that can be used in conjunction with conventionally mounted panels in existing installations. The preferred of these embodiments is the fourth embodiment, which is best suited to installations using one to three panels.

A fifth embodiment is for use in conjunction with direct mount installations that employ female hardware components installed in the structure. The preferred embodiment is a stepped quick release sleeve assembly that utilizes a two stepped bolt and a three stepped sleeve used to attach and quick release panels to and from a structure. Variations of this embodiment are used to attach and quick release track to and from a structure having the same effect, and a sleeveless variation thereof that employs a bolt, washer and pin to achieve the same purpose for attaching and releasing track.

The sixth embodiment is for use in conjunction with direct mount installations that make use of male hardware components installed in the structure. The preferred embodiment uses a dual quick release sleeve assembly and spacer combination with the pin accessible from inside the structure. At least one tab on each of the two sleeves accommodates the pin which cannot be in the center of the assembly because the male hardware component occupies this space. As with the fifth embodiment, a variation of this alternate embodiment can utilize a two or three stepped second sleeve and fender washer combination to minimize the potential for failure from human error or misuse that can result from over tightening of the wing nut on the panel.

The seventh embodiment employs a sleeveless system employs a bolt, washer and pin to achieve the purpose of securing a track or a panel to a structure. An eighth embodiment comprises an internal car with a release mechanism that is disposed within the channel of an F-Track and connected to an extraction mechanism by a cable or lanyard through an actuator designed to redirect the vertical force applied by the extraction mechanism to a horizontal force for extracting the pin and releasing the bolt from the car within the F-Track channel.

Further, the advantages of the first, fifth and sixth embodiments are that they utilize conventional installation methods without modifications to the panels or engineering requirements of existing industry standard installation methods.

The construction and use of each embodiment will become clear in the detailed description of the figures and corresponding embodiments of the invention below.

DETAILED DESCRIPTION OF THE DRAWINGS

Figure 1B:
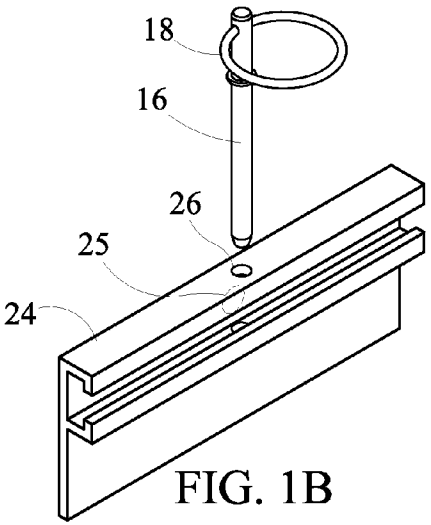
FIG. 1B shows a view of F-Track modified to accommodate the quick release bolt and pin of the first embodiment.
Figure 1A:
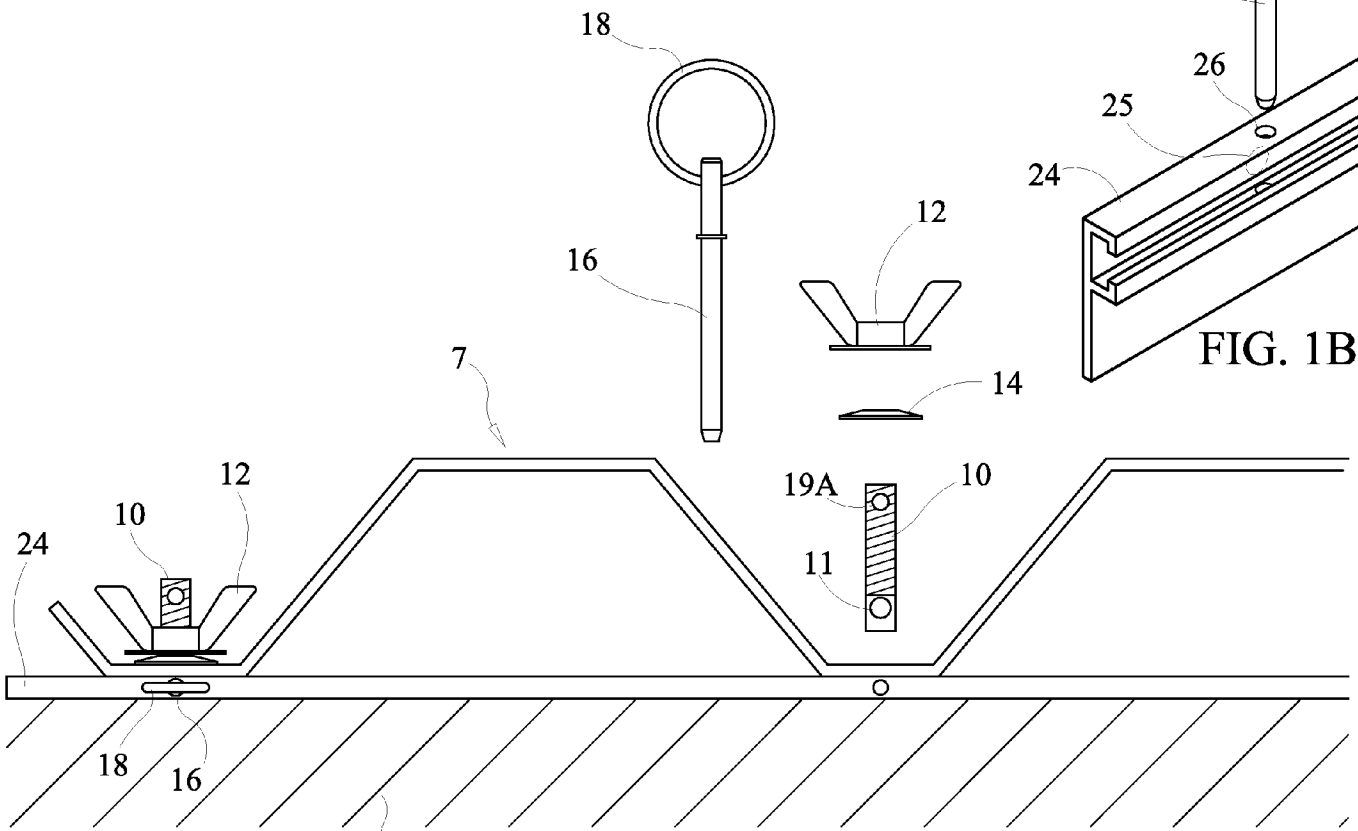
FIG. 1A shows the components of the quick release bolt assembly of the first embodiment as disassembled and a top down view of the components as assembled with a section of hurricane panel mounted in a section of F-Track.

FIG. 1A shows the components of the quick release bolt assembly in the center as disassembled with a section of F-Track 24. The components include a quick release bolt 10 which has a hole at one end 11 disposed and sized to accommodate a pin 16. The pin 16 has an optional ring 18 for making a connection to an optional extraction mechanism, although any hardware suitable for connecting the pin to an extraction mechanism, including but not limited to a cable, lanyard, multiple rings or a combination thereof can be used for this purpose. A wing nut 12 and optional washer 14 are also shown. An optional second hole 19A is shown at the distal end of the quick release bolt, and the function of this second hole is discussed in more detail under the description of FIGS. 3A and 3B.

The structure 80 is shown in a cut-away view with a section of F-Track 24 attached to said structure. The F-Track 24 is modified to accommodate a quick release bolt 10 at each attachment point, as discussed in more detail under FIG. 1B below. A section of soft hurricane panel 7 is shown as attached with the quick release bolt assembly on the left attachment point. The quick release bolt 10 is attached to the F-Track 24 with the pin 16. When the soft panel 7 positioned at its attachment points over the quick release bolt 10, the soft panel 7 can be secured to the F-Track 24 with the wing nut 12. In this view, the assembly is shown with the optional washer 14 between the wing nut 12 and the soft panel 7; and the optional ring 18 is shown as attached to the pin 16.

FIG. 1B shows a view of F-Track 24 modified with holes in the top and bottom track channels 26 to accommodate the pin 16, and a hole in the back of the track channel 25 to enable the quick release bolt (not shown) to be recessed into the back of the track channel.

Figure 2B:
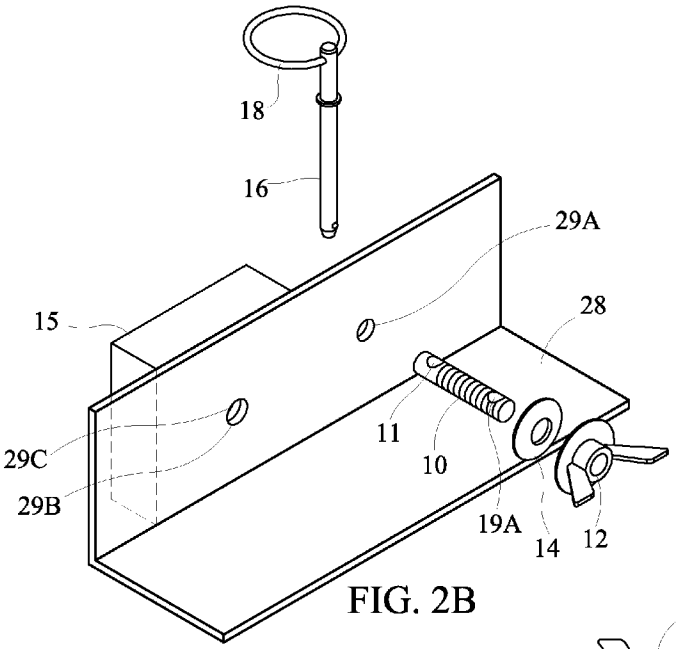
FIG. 2B shows an illustration of the studded angle track as modified to accommodate the components of the first embodiment.
Figure 2A:
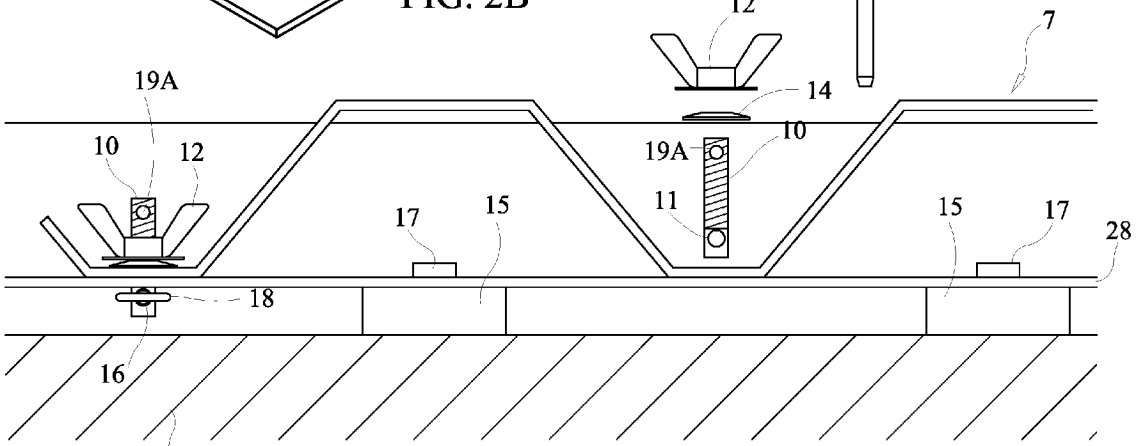
FIG. 2A shows the components of the quick release bolt assembly of the first embodiment as disassembled and a top down view of the components as assembled with a section of hurricane panel mounted in a section of studded angle track. The studded angle track is shown mounted to the structure with spacers, which are necessary to make room between the back of the studded angle track and the structure.

FIG. 2A shows the components of the quick release bolt assembly in the center as disassembled with a section of studded angle track 28. The components include a quick release bolt 10 which has a hole at one end 11 disposed and sized to accommodate a pin 16. The pin 16 has an optional ring 18 for making a connection to an optional extraction mechanism, although any hardware suitable for connecting the pin to an extraction mechanism, including but not limited to a cable, lanyard, multiple rings or a combination thereof can be used for this purpose. A wing nut 12 and optional washer 14 are also shown. An optional second hole 19A is shown at the distal end of the quick release bolt, and the function of this second hole is discussed in more detail under the description of FIGS. 3A and 3B.

The structure 80 is shown in a cut-away view with a section of studded angle track 28 attached to said structure with spacers 15 and tapcons 17 which along with sidewalk bolts (not shown) and female hardware (not shown) are among the industry standard methods for attaching track to a structure. These spacers 15 are used to create space between the back of the studded angle track 28 and the structure 80 to accommodate the quick release bolt 10 and pin 16. The studded angle track 18 is modified to accommodate a quick release bolt 10 at each attachment point, as discussed in more detail under FIG. 2B below. A section of soft hurricane panel 7 is shown as attached with the quick release bolt assembly on the left attachment point. The quick release bolt 10 is passed through a hole in the studded angle track 28 and attached with the pin 16 on the inboard (back) side of the studded angle track 28. When the soft panel 7 positioned at its attachment points over the quick release bolt 10, the soft panel 7 and quick release bolt 10 are secured in place to the studded angle track 28 the with the wing nut 12. In this view, the assembly is shown with the optional washer 14 between the wing nut 12 and the soft panel 7; and the optional ring 18 is shown as attached to the pin 16, and the pin rests and is tensioned on the inboard (back) side of the studded angle track 28.

FIG. 2B shows a view of studded angle track 28 modified by the removal of studs at the attachment points where the soft panels (not shown) are attached to create holes 29A for the quick release bolts 10. The mounting holes 29B in the studded angle track 28 correspond to mounting holes 29C in the spacers 15. When studded angle track 28 is used in conjunction with the quick release bolt assembly, if the studded angle track 28 cannot be mounted on the ground in a position to provide space for the quick release bolt and pin on the inboard side of the studded angle track 28, then the studded angle track is mounted with spacers 15, which are ideally dispersed between attachment points for the soft panels (not shown).

Figure 3A:
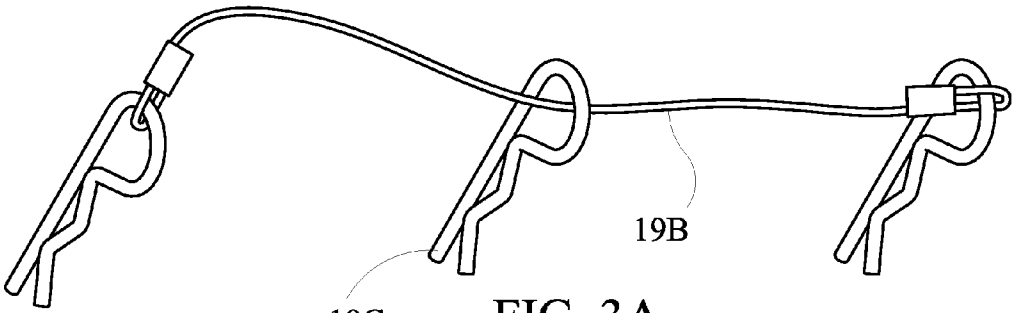
FIG. 3A shows a lanyard disposed with hitch pin clips used to keep the components of various embodiments from scattering when they are released.
Figure 3B:
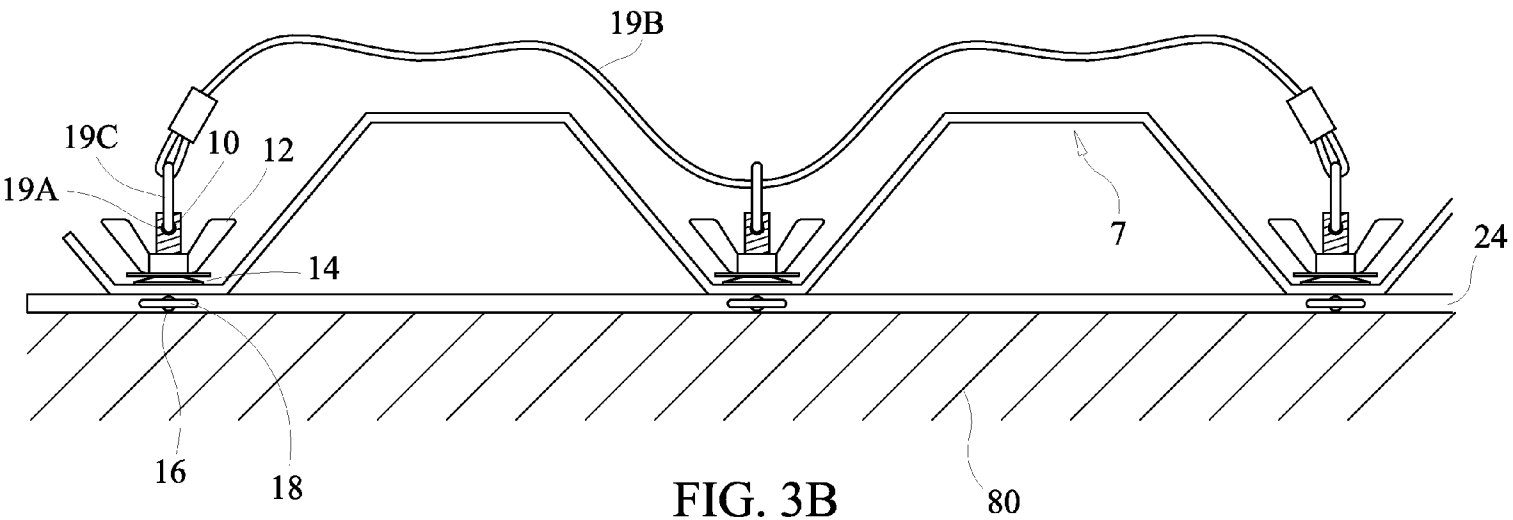
FIG. 3B shows an example of the lanyard and hitch pin clips attached to the quick release bolts of the first embodiment to illustrate how the components of various embodiments can be connected together to prevent the parts from scattering when the pins are extracted and the panels removed.

FIGS. 3A and 3B illustrate a method for using a cable or lanyard 19B or series thereof in conjunction with a second set of pins 19C to connect a series of quick release bolts 10 together through optional second holes 19A in the quick release bolts 10. When a series of quick release bolts 10 are attached together utilizing this method, they are prevented from scattering when the components are released. Although this method is shown herein with a series of quick release bolts, the concept can be applied to other embodiments including but not limited to the quick release sleeve assembly, the stepped quick release sleeve assembly and the dual quick release sleeve assembly, all of which are discussed in detail in this application.

FIG. 3B shows an example of the lanyard and hitch pin clips attached to the quick release bolts of the first embodiment to illustrate how the components of various embodiments can be connected together to prevent the parts from scattering when the pins are extracted and the panels removed.

Figure 4A:
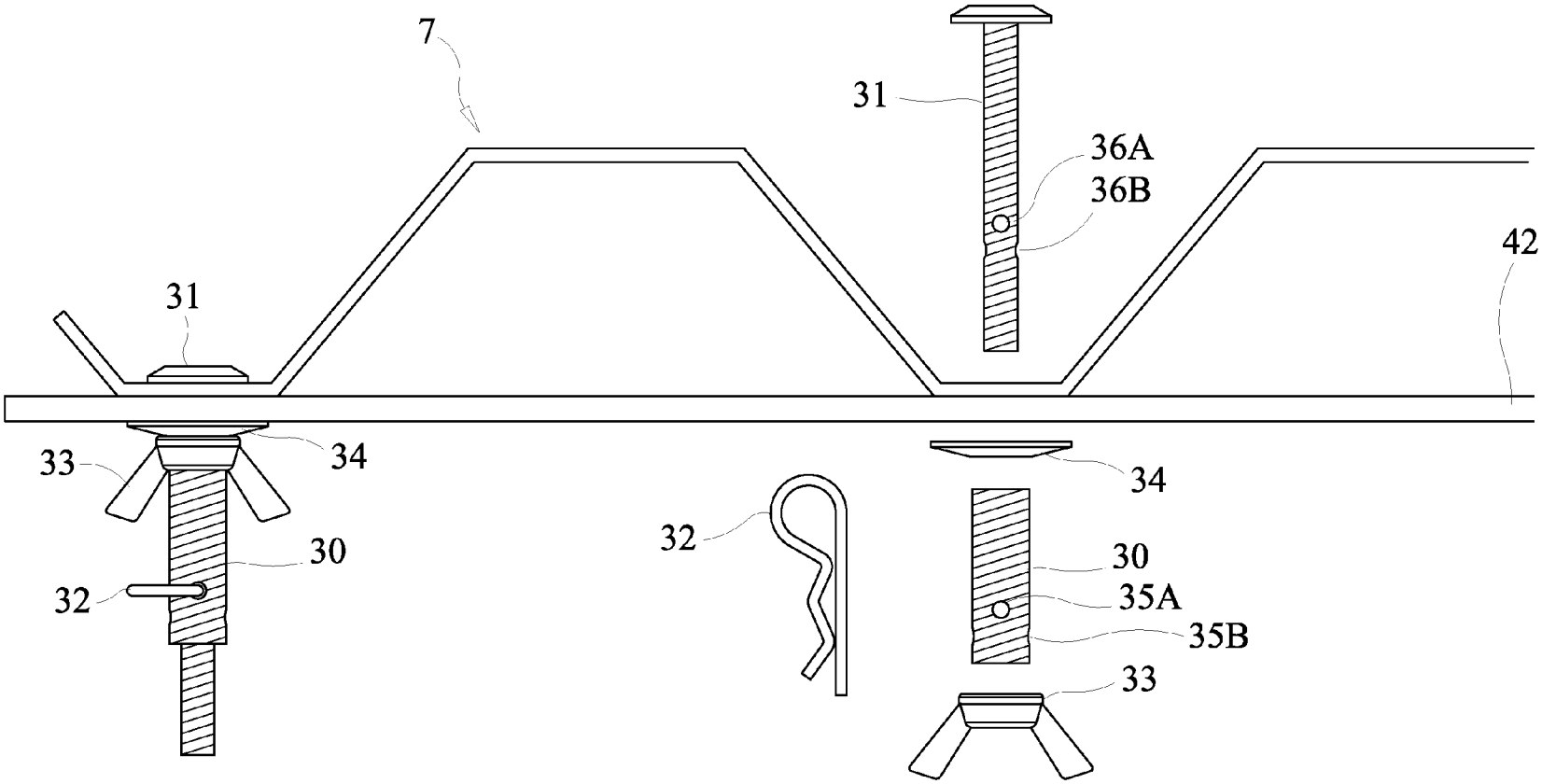
FIG. 4A shows the components of the quick release bolt assembly of the second, third and fourth embodiments as disassembled and a top down view of the components as assembled with a section of hurricane panel mounted in a section of bar track of the fourth embodiment.

FIG. 4A shows the components of the quick release sleeve assembly of the second, third and fourth embodiments in the center as disassembled, and shown with the bar track 42 of the fourth embodiment. The components include a standard sidewalk bolt 31 modified with at least one pin hole 36A on its shaft. An optional second hole 36B can be used to accommodate different thicknesses of panels and other hardware. In this fourth embodiment, the head of the sidewalk bolt 31 is located on the outboard side of the bar track 42, and the soft panel 7 is disposed between the head of the sidewalk bolt 31 and the bar track 42, with the shaft of the sidewalk bolt 31 passing through the soft panel 7 at its connection point and a corresponding hole in the bar-track 42 (not visible in this view). On the inboard side of the bar track 42 are the quick release sleeve 30 with a hole 35A to accommodate a pin 32 to correspond with the hole 26A in the sidewalk bolt 31. An optional hole 35B is shown in the quick release sleeve 30 to also accommodate different thicknesses of panels and other hardware. Thus if optional holes 36B and 35B are used, then holes 35A or 35B can be combined with either of holes 36A and 36B to accommodate a variety of hardware components of different specification such thus maximizing the options for a best fit without having to customize hardware for each specific installation . . . quick release bolt 10 which has a hole at one end 11 disposed and sized to accommodate a pin 16. The particular pin 32 used with the second, third and fourth embodiments is a hitch pin clip which can be attached to an extraction mechanism with a ring, cable, lanyard or other hardware for connecting (not shown).

The structure 80 is shown in a cut-away view with a section of bar track 42 which is attached to the outside of the structure 80 proximate an opening in said structure 80, and a section of soft panel 7.

While a bar track 42 is the preferred method four use with the fourth embodiment because of its strength and low profile, the same purpose can be achieved using a section of studded angle track (not shown) with the studs removed at the attachment points of the soft panel 7.

The view at the connection point on the left shows the soft panel 7 attached with the stepped quick release sleeve assembly. The soft panel 7 is held in place by the head of the sidewalk bolt 31, and is held in place on the bar track 42 by the wing nut 33 which is tensioned on the quick release sleeve 30 which is connected to the sidewalk bolt 31 with the pin 32. In this view, the assembly is shown with the optional washer 14 between the wing nut 12 and the soft panel 7.

Figure 4B:
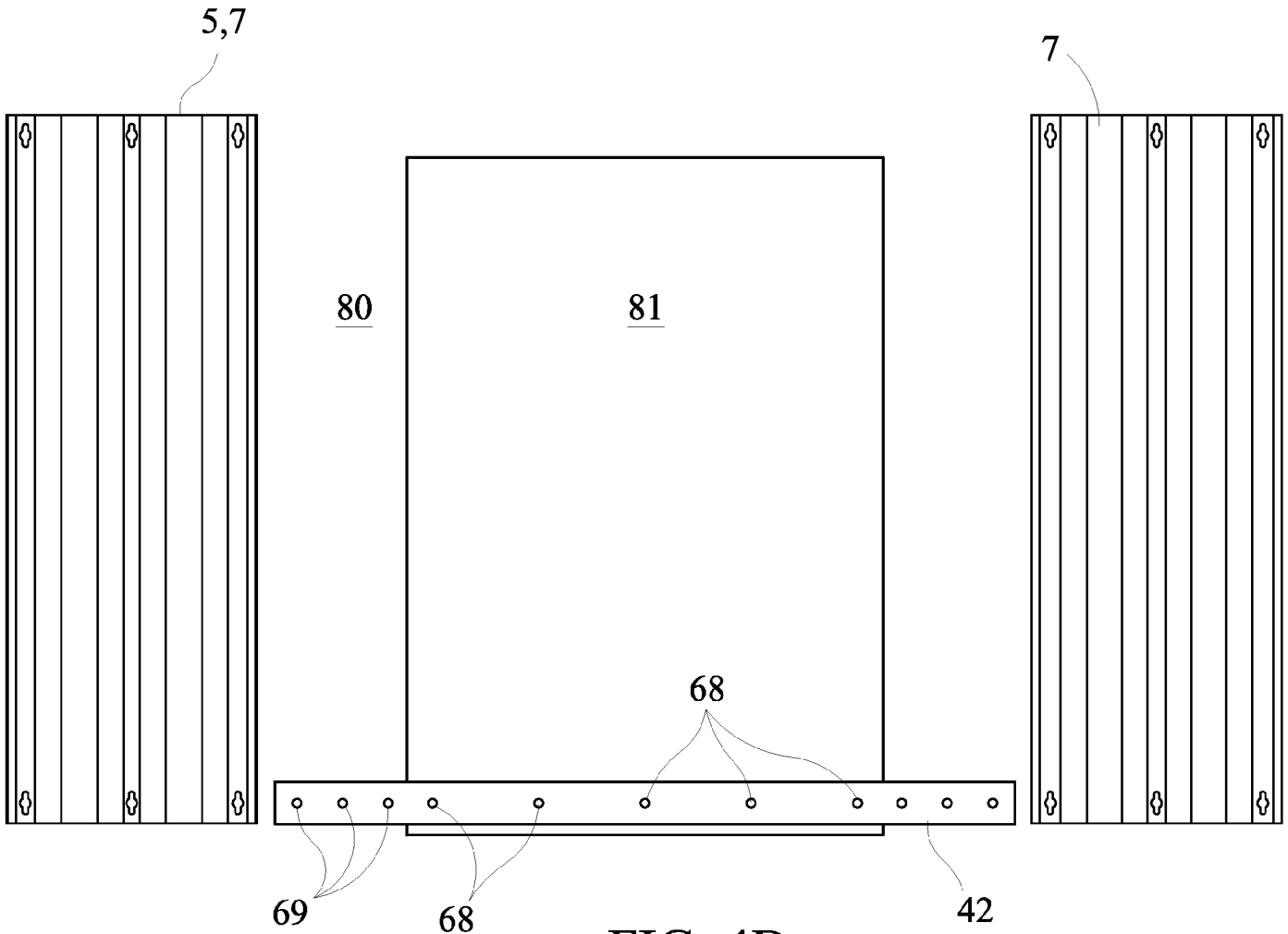
FIG. 4B illustrates a section of bar track as used with the fourth embodiment in an opening sized for a two panel installation.

FIG. 4B illustrates a section of bar track 42 as used with the fourth embodiment in an opening sized for a two panel installation. The bar track 42 is attached to the structure 80 at three points on each side 69 of the opening in the structure 81. The bar track 42 has five holes 68 corresponding to the attachment points of two panels which overlap at the center attachment point. The sidewalk bolts (not shown) of the quick release bolt assembly pass through these holes 68 in the bar track 42. In a two panel embodiment, one panel, in this case the one on the right is a soft panel 7, and the second panel show on the left can be either a soft panel 7 or a hard panel 5. If one of these two panels were a hard panel 5, then the hard panel 5 would be attached by non-removable hardware at the two connection points that do not overlap the soft panel 7. This same concept also applies to installations of more than two panels. It should also be noted that if a hard panel is used with this embodiment, the hard panel 5 must be placed in position first so it rests below the soft panel 7, otherwise it will not be possible to remove the soft panel 7. When the pins (not shown) are extracted from the quick release bolt assemblies (not shown), the sidewalk bolt and soft panels 7 are released.

Figure 4C:
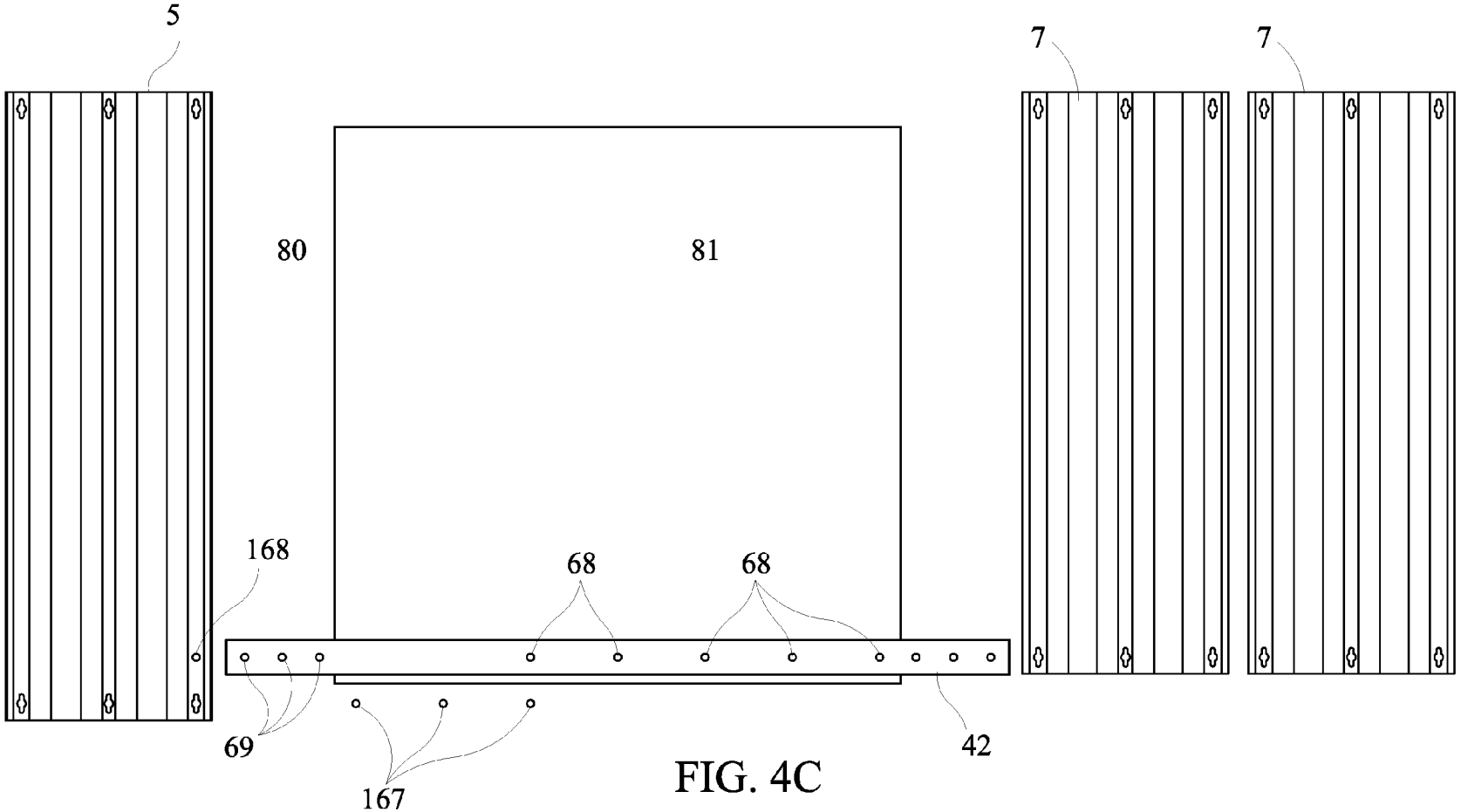
FIG. 4C illustrates the fourth embodiment in an opening sized for a three panel installation wherein the panel on the left is a hard panel to be attached to direct mount hardware in the structure below the opening and the center and right panels are soft panels are to be attached to a section of bar track with the quick release sleeve assembly.

FIG. 4C illustrates a variation of the fourth embodiment in an opening sized for a three panel installation with one hard panel 5 (on the left) and two soft panels 7 (on the right). This installation utilizes bar track 42 which is mounted to the structure 80 at three points 42 on either side of the opening 81. In this installation, the hard panel 5 is mounted to the structure with either of male or female hardware 167 and is thus of greater length than the soft panels 7 which are mounted on the bar track 42 in the mounting holes 68. The hard panel 5 is modified with a hole 168 sized and disposed to accommodate the mounting hole in the overlapping soft panel 7, which is installed over and after the hard panel 5 is put in place. When the pins (not shown) are extracted from the quick release bolt assemblies (not shown), the sidewalk bolt and soft panels 7 are released.

Figure 4D:
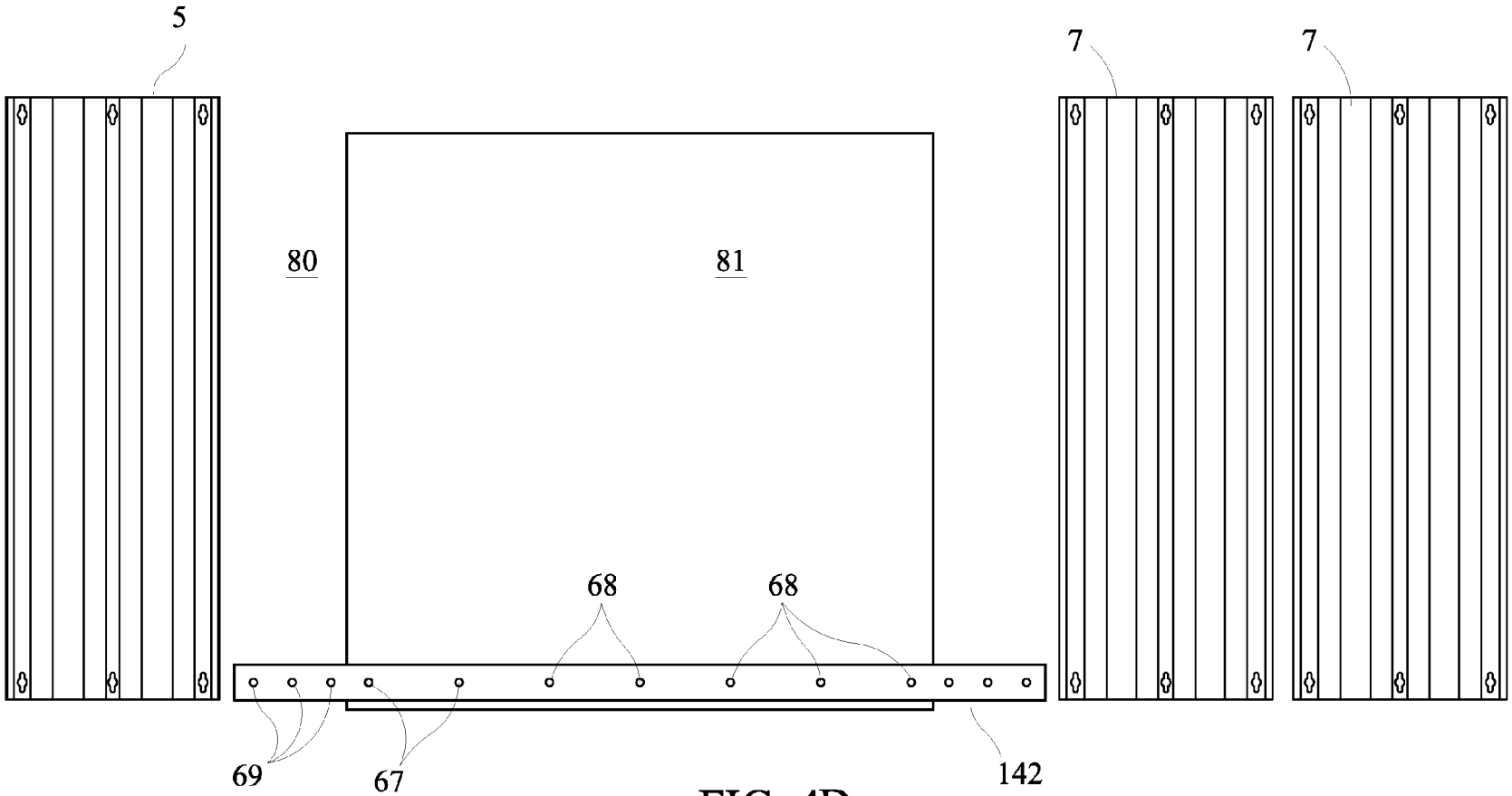
FIG. 4D illustrates the fourth embodiment in an opening sized for a three panel installation utilizing a section of modified studded angle track, wherein the panel on the left is a hard panel to be attached with wing nuts to the two remaining studs on the left side of the modified studded angle track, and the center and right panels are soft panels to be attached to the modified studded angle track with the quick release sleeve assembly. Note that the right side connection of the hard panel will rest under the left side connection of the soft panel and will where both are connected with a quick release sleeve assembly.

FIG. 4D illustrates a variation of the fourth embodiment in an opening sized for a three panel installation with one hard panel 5 (on the left) and two soft panels 7 (on the right). This installation utilizes a section of modified studded angle track 142 which has the five studs on the right and studs on either side of the opening 81 removed, and which is mounted to the structure 80 at three points 69 on either side of the opening 81. In this installation, the hard panel 5 is attached to the studded angle track at the two non-overlapping points on the left using the remaining studs 67. The hard panel 5 must be placed in position first, and below the soft panel 7 and the overlapping points on the left hard panel 5 and the center soft panel 7 are secured together by one of the quick release bolt assemblies. When the pins (not shown) are extracted from the quick release bolt assemblies (not shown), the sidewalk bolt and soft panels 7 are released.

Figure 5A:
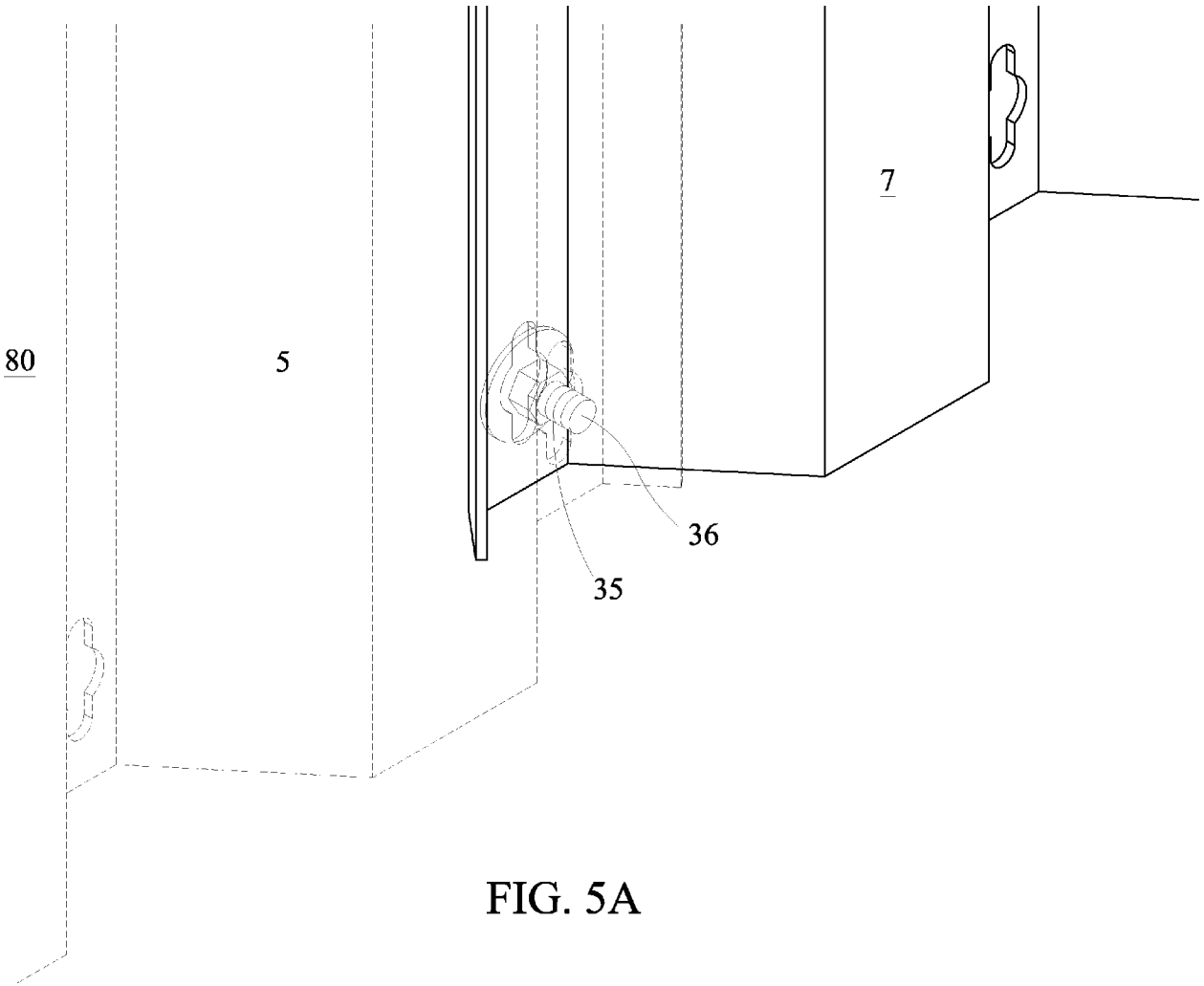
FIG. 5A shows a flanged nut used to make the transition between a hard and soft panel, with the hard panel attached with the flanged nut and the soft panel resting over the hard panel and flanged nut.
Figure 5C:
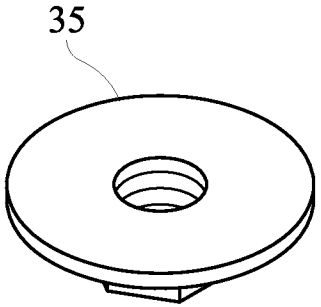
FIGS. 5B, 5C, 5D and 5E show various views of the flanged nut used for transitioning between hard and soft panels.
Figure 5E:
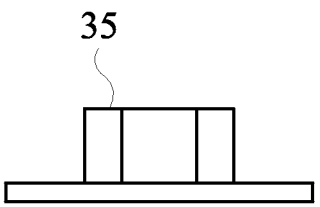
Figure 5B:
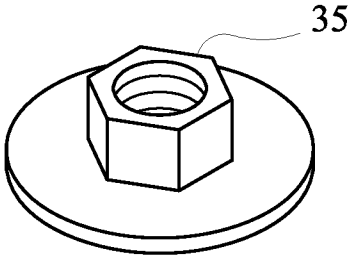
Figure 5D:
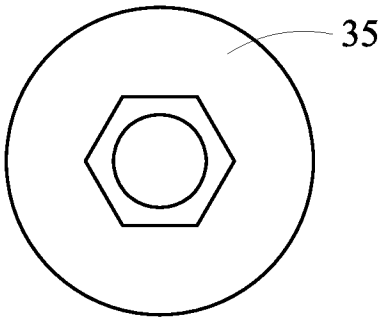

FIG. 5A illustrates how a flanged nut 35 used to make the transition between a hard panel 5 and a soft panel 7 in the second and third embodiments. As shown, the hard panel 5 sits underneath the soft panel 7, and the hard panel 5 is secured to the structure with the flanged nut 35 which is threaded and tensioned on to a stud in a section of studded angle track or a male hardware component 36. The soft panel is placed over the hard panel and is not connected at this overlapping point.

FIGS. 5B, 5C, 5D and 5E show various views of the flanged nut 35 used for transitioning between hard and soft panels in the second and third embodiments.

Figure 6:
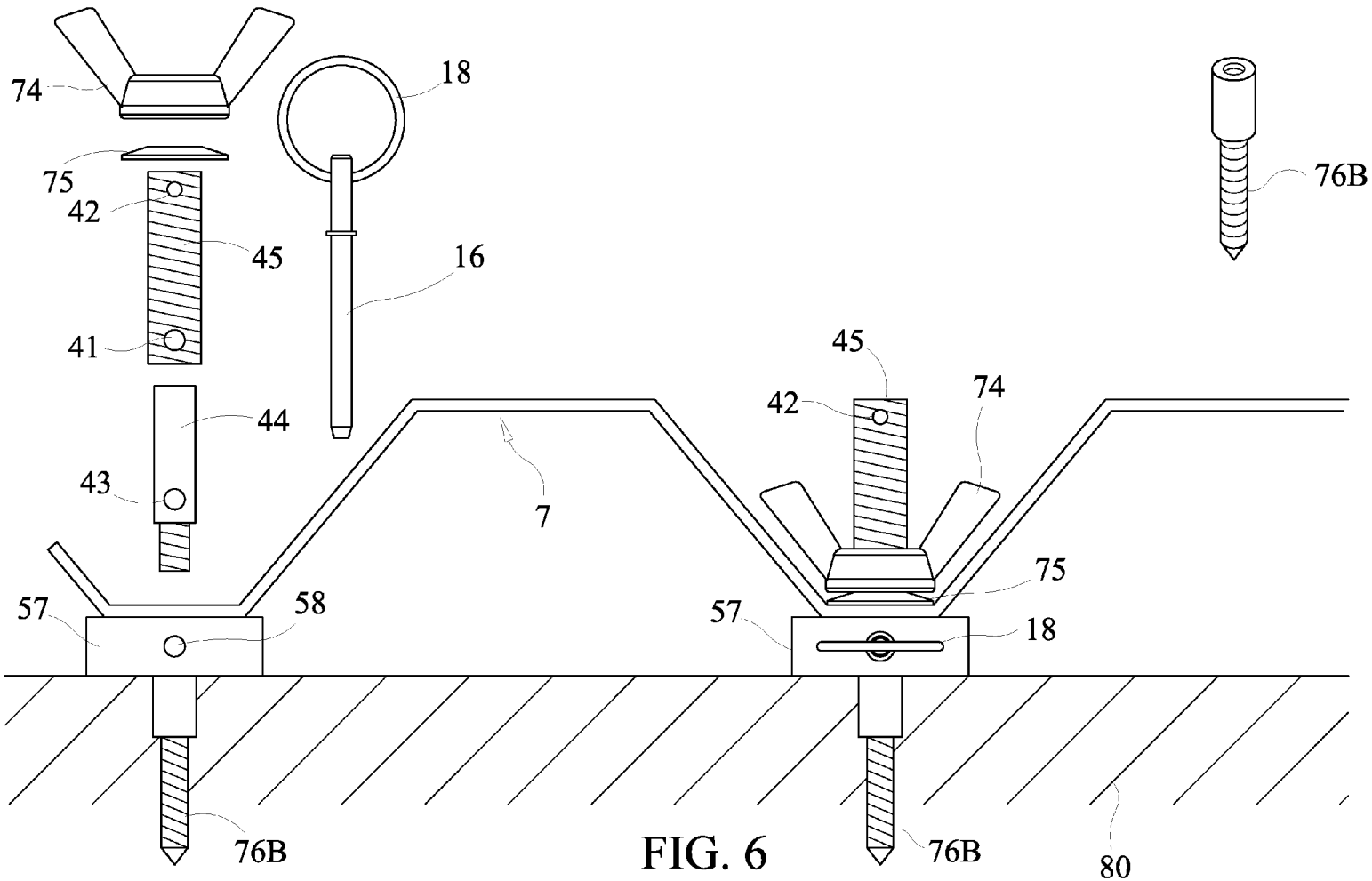
FIG. 6 shows the components of an alternate embodiment of the stepped quick release sleeve assembly of the fifth embodiment as disassembled and a top down view of the components as assembled with a section of hurricane panel mounted in female direct mount hardware installed in a structure.

FIG. 6 shows the components of an alternate embodiment of the stepped quick release sleeve assembly of the fifth embodiment as disassembled on the left and in a top down view as assembled on the right with a section of soft hurricane panel 7 mounted in female direct mount hardware 76B installed in a structure 80.

Shown in this top-down view with cut-away view of the structure 80, the stepped bolt 44 is threaded into the female hardware component 76B. A spacer 57 with a hole (not shown here and shown as 59 in FIGS. 7A and 7B) through the center of its depth and a second cross-bored hole 58, and a quick release sleeve 45 are put in place over the stepped bolt 44 and connected with a pin 16 through the pin holes 43, 41 and 57. The soft panel 7 is placed over the quick release sleeve 45 and is tensioned in place with a wing nut 74. In this view, also shown are an optional washer 75 which is placed between the soft panel 7 and the wing nut 74, and an optional ring 18 for connecting the pin 16 to an optional extraction mechanism.

Figure 7B:
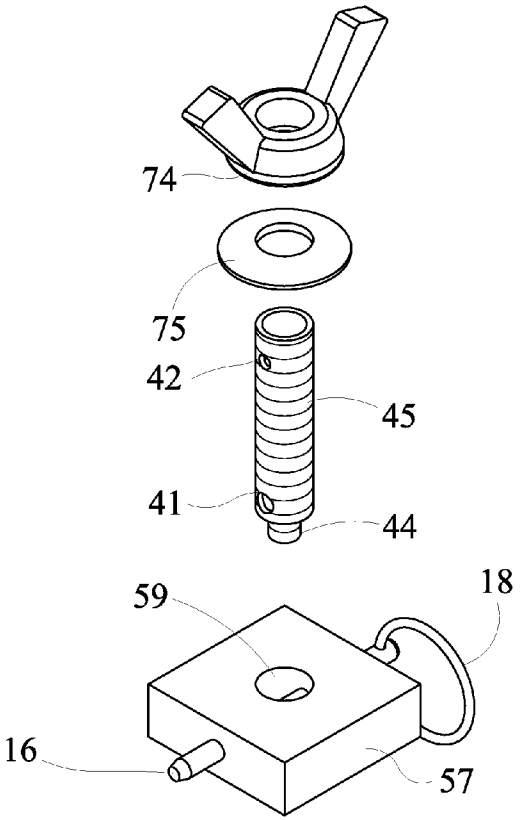
FIGS. 7A and 7B show additional views of the components of an alternate embodiment of the stepped quick release sleeve which further illustrate how the components fit together.
Figure 7A:
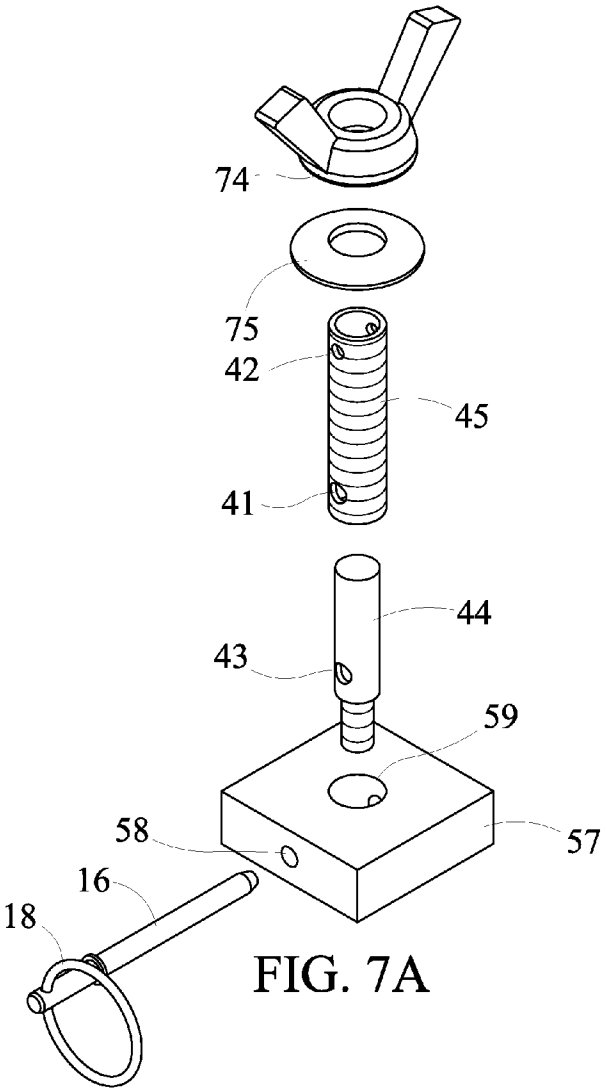

FIGS. 7A and 7B show additional views of the components of an alternate embodiment of the stepped quick release sleeve assembly which further illustrate how the components are sequenced and fit together.

Figures 8A, 8B:
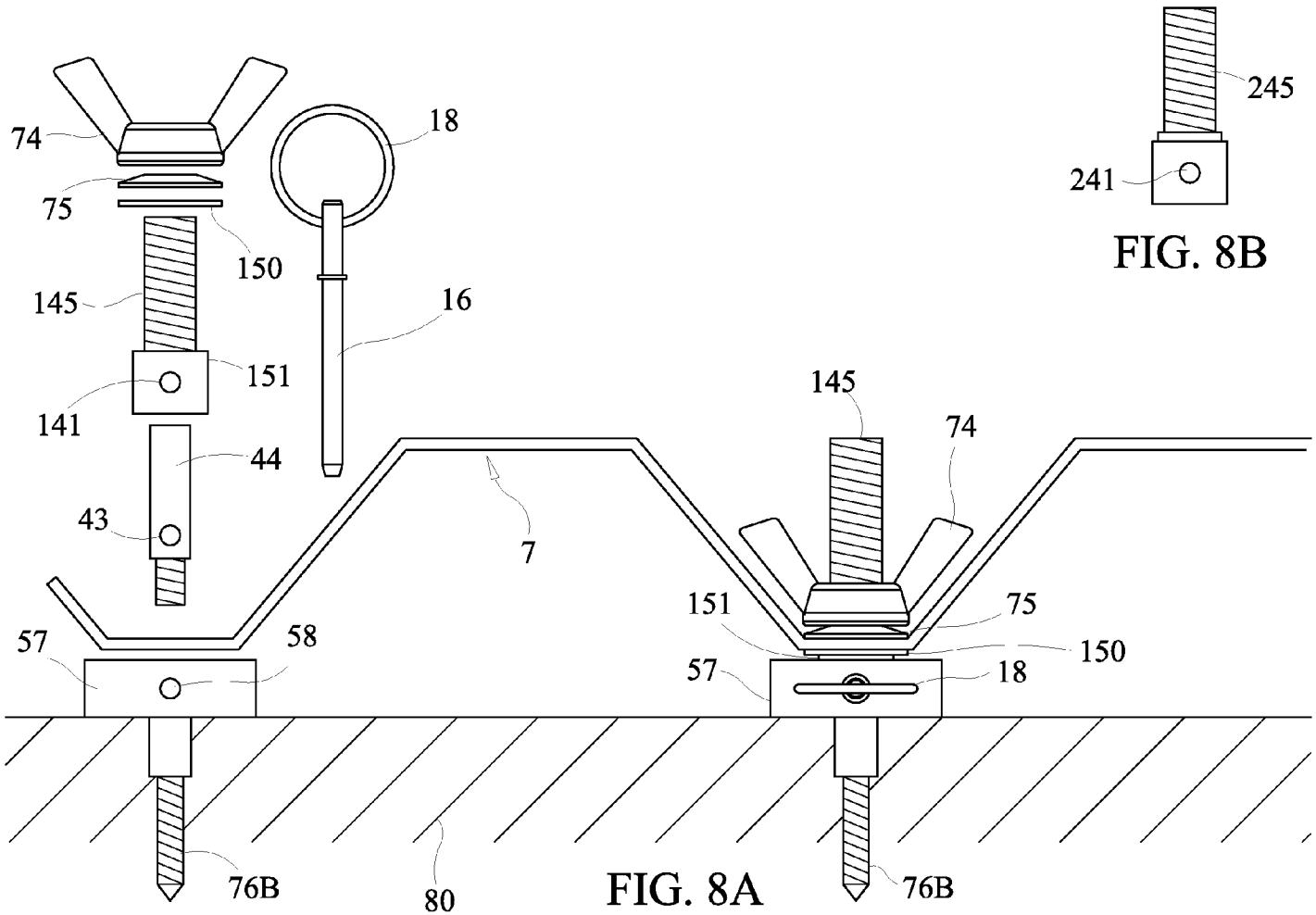
FIG. 8A shows the components a stepped quick release sleeve assembly of the fifth embodiment utilizing a two-stepped sleeve as disassembled and a top down view of the components as assembled with a section of hurricane panel mounted in female direct mount hardware installed in a structure.
FIG. 8B shows a three-stepped sleeve of the preferred embodiment of the stepped quick release sleeve assembly.

FIG. 8A shows the components a stepped quick release sleeve assembly of the fifth embodiment utilizing a two-stepped quick release sleeve 145. On the left is shown the components as disassembled, and on the right is shown a top down view as assembled with a section of soft hurricane panel 7 mounted in female direct mount hardware 76B installed in a structure 80.

Shown in this top-down view with cut-away view of the structure 80, the stepped bolt 44 is threaded into the female hardware component 76B. A spacer 57 with a hole (not shown here and shown as 59 in FIGS. 7A and 7B) through the center of its depth and a second cross-bored hole 58, and a two-stepped quick release sleeve 145 are put in place over the stepped bolt 44 and connected with a pin 16 through the pin holes 43, 141 and 58. The first end 151 of the two-stepped sleeve 145 in this illustration is unthreaded, is wider than the threaded end and has a depth that is greater than the depth of the spacer 57, thus creating a shoulder that extends beyond the spacer 57. A fender washer 150 or similar component is disposed over the two-stepped quick release sleeve 145 before the soft panel 7 is put in place. This fender washer 150 resting on the shoulder of the first end of the two-stepped quick release sleeve 145 serves to support the soft panel 7 at its connection point and take the tension to secure the soft panel 7 when the wing nut 74 is tightened down on the soft panel 7, thus preventing the pin 16 from binding in the assembly should the wing nut 74 be over tightened on the threaded end of the two-stepped quick release sleeve 145. In this view, also shown are an optional washer 75 which is placed between the soft panel 7 and the wing nut 74, and an optional ring 18 for connecting the pin 16 to an optional extraction mechanism.

In an alternate embodiment, if the diameter of the first end 151 of the two-stepped sleeve 145 is sufficiently greater than the hole in the soft panel 7 at the attachment point, then the fender washer 150 may be omitted and the surface of the shoulder at the first end 151 of the two-stepped quick release sleeve 145 can serve to support the soft panel at its attachment point.

FIG. 8B shows a three-stepped quick release sleeve 245 of the preferred embodiment of the stepped quick release sleeve assembly. If used, this three-stepped quick release sleeve 245 is substituted for the two-stepped quick release sleeve 145 of FIG. 8A, however the pin hole is labeled as 241, and the fender washer 150 of FIG. 8A is pressed on to the middle step of the three-stepped quick release sleeve 245. Having the fender washer pressed on prevents the fender washer from becoming separated from the three-stepped quick release sleeve 245, and further serves to prevent failures that could result from the fender washer from being installed in the incorrect sequence or omitted altogether by user error.

Figure 9:
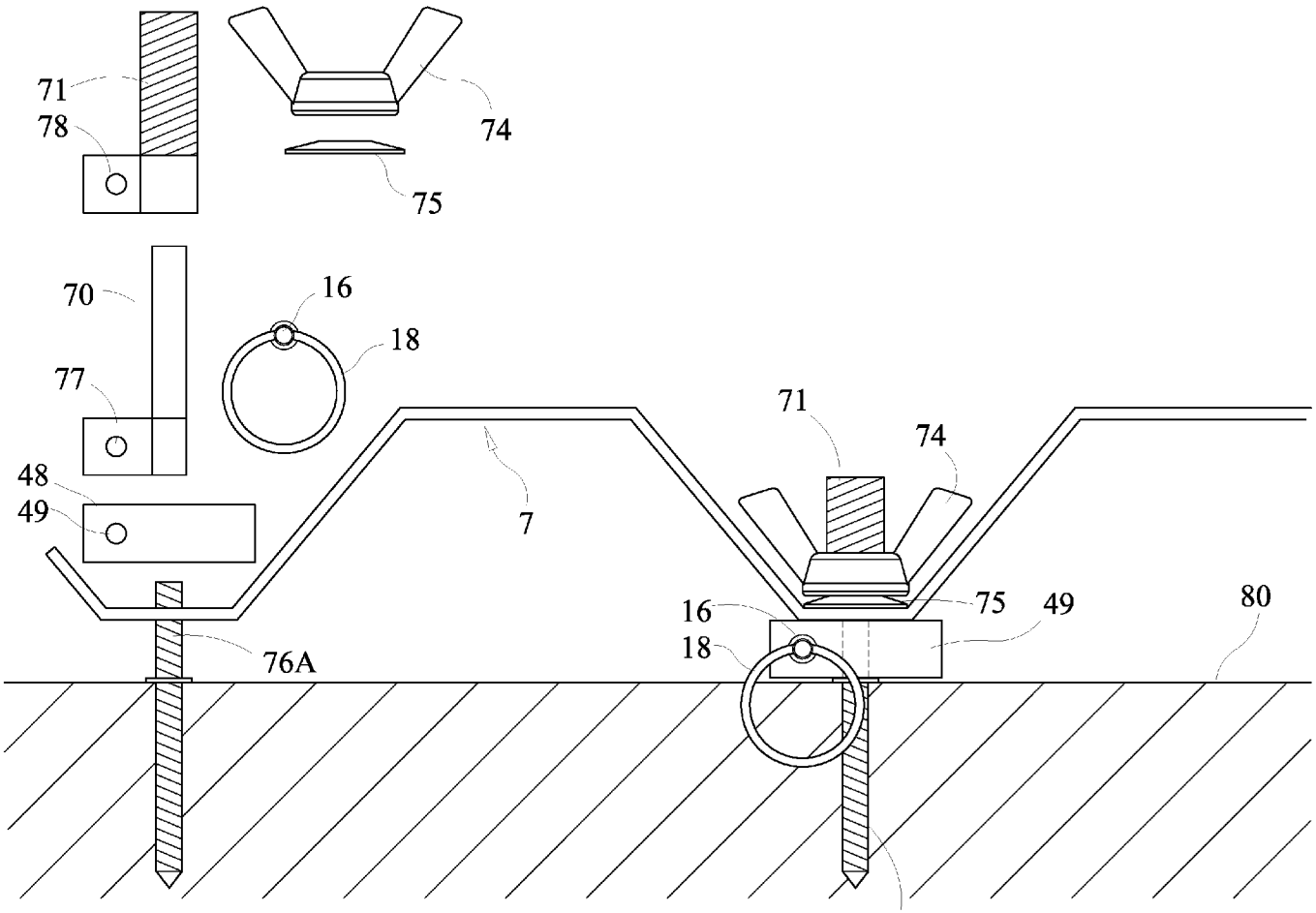
FIG. 9 shows the components of an the dual quick release sleeve assembly of the sixth embodiment as disassembled and a top down view of the components as assembled with a section of hurricane panel mounted in male direct mount hardware installed in a structure.

FIG. 9 shows the components of an alternate embodiment the dual quick release sleeve assembly of the sixth embodiment as disassembled on the left and in a top down view as assembled on the right with a section of soft hurricane panel 7 mounted in male direct mount hardware 76A installed in a structure 80.

Shown in this top-down view with cut-away view of the structure 80, the first sleeve 70 having at least one tab 77 on one end with a hole sized to accommodate a pin 16 is threaded into the male hardware component 76A. A spacer 57 with a u-channel (not shown here and shown as 49 in FIGS. 10A and 10B) through its depth and a second cross-bored hole 48, and a second sleeve 71 having at least one tab 78 at one end corresponding to the tab and hole on the first sleeve 77 are put in place over the first sleeve 70 and connected with a pin 16 through the pin holes 48, 77 and 78. The soft panel 7 is placed over the second sleeve 71 and is tensioned in place with a wing nut 74. In this view, also shown are an optional washer 75 which is placed between the soft panel 7 and the wing nut 74, and an optional ring 18 for connecting the pin 16 to an optional extraction mechanism.

Figure 10B:
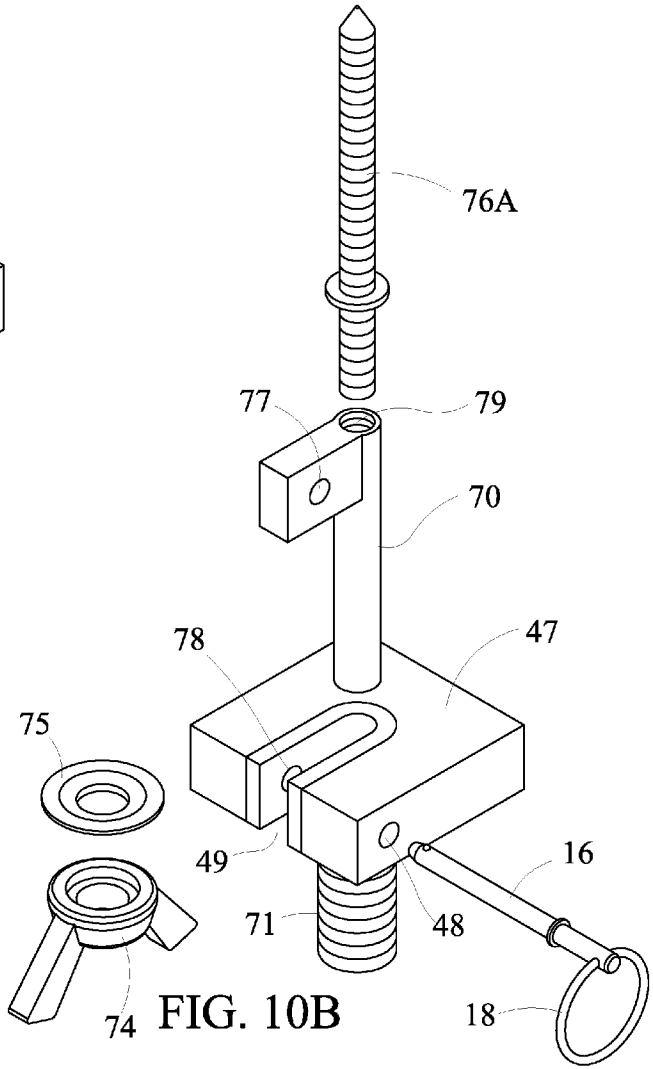
FIGS. 10A and 10B show additional views of the components of the dual quick release sleeve assembly which further illustrate how the components fit together.
Figure 10A:
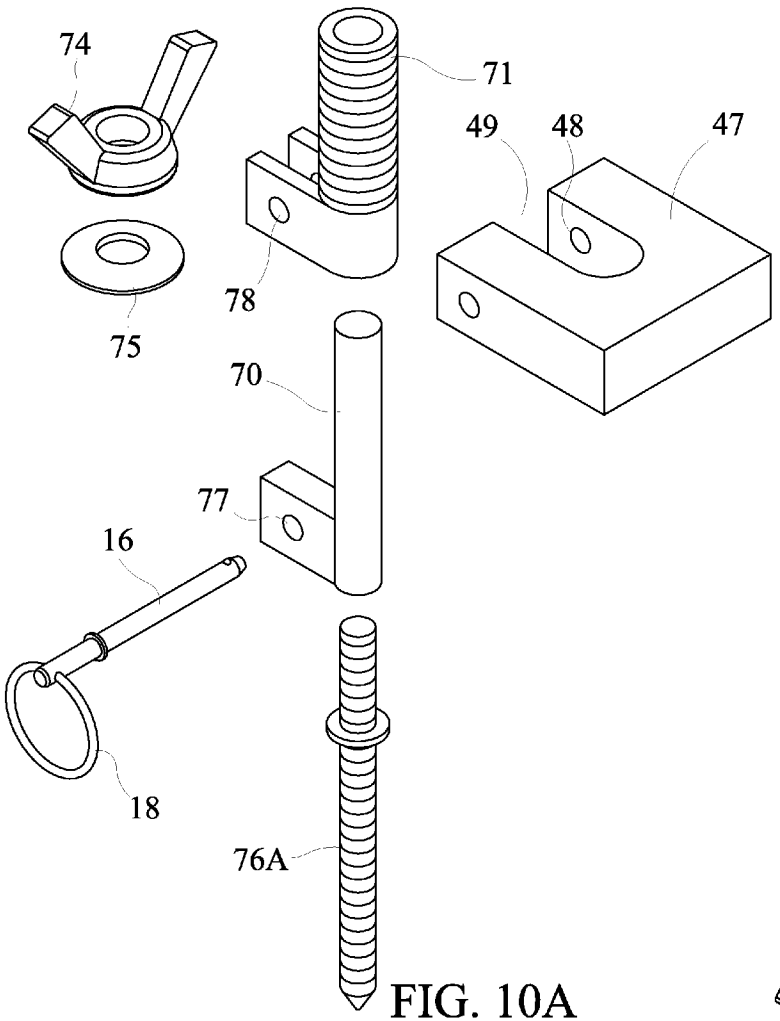

FIGS. 10A and 10B show additional views of the components of an alternate embodiment of the stepped quick release sleeve assembly which further illustrate how the components are sequenced and fit together.

Figure 10D:
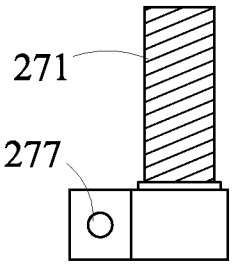
FIGS. 10C and 10D show views of two-stepped and three-stepped second sleeves of the dual quick release sleeve assembly.
Figure 10C:
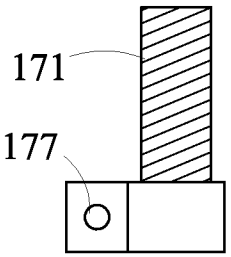

FIG. 10C shows a two-stepped second sleeve 171 of the preferred embodiment of the dual quick release sleeve assembly. If used, this three-stepped second sleeve 171 is substituted for the second sleeve 71 shown in FIGS. 9, 10A and 10B, however the pin hole is labeled as 177, and the fender washer 150 of FIG. 8A is disposed between the spacer 47 and the two-stepped second sleeve 171 and serves to support the soft panel 7 at its attachment point and take up the tension of the wing nut 74, thereby preventing the pin from binding if the wing nut 75 is over tightened on the assembly. As with the two-stepped quick release sleeve 145 of FIG. 8A, this two-stepped second sleeve 171 of the dual quick release sleeve assembly can be used without the fender washer if the diameter of the larger step on the first end is sufficiently large to lend support for the soft panel 7 at its connection points.

FIG. 10D shows a three-stepped second sleeve 271 of the preferred embodiment of the dual quick release sleeve assembly. If used, this three-stepped second sleeve 271 is substituted for the second sleeve 71 shown in FIGS. 9, 10A and 10B, however the pin hole is labeled as 277, and the fender washer 150 of FIG. 8A is pressed on to the middle step of the three-stepped second sleeve 271. Having the fender washer pressed on prevents the fender washer from becoming separated from the three-stepped second sleeve 271, and further serves to prevent failures that could result from the fender washer from being installed in the incorrect sequence or omitted altogether by user error.

Figure 11A:
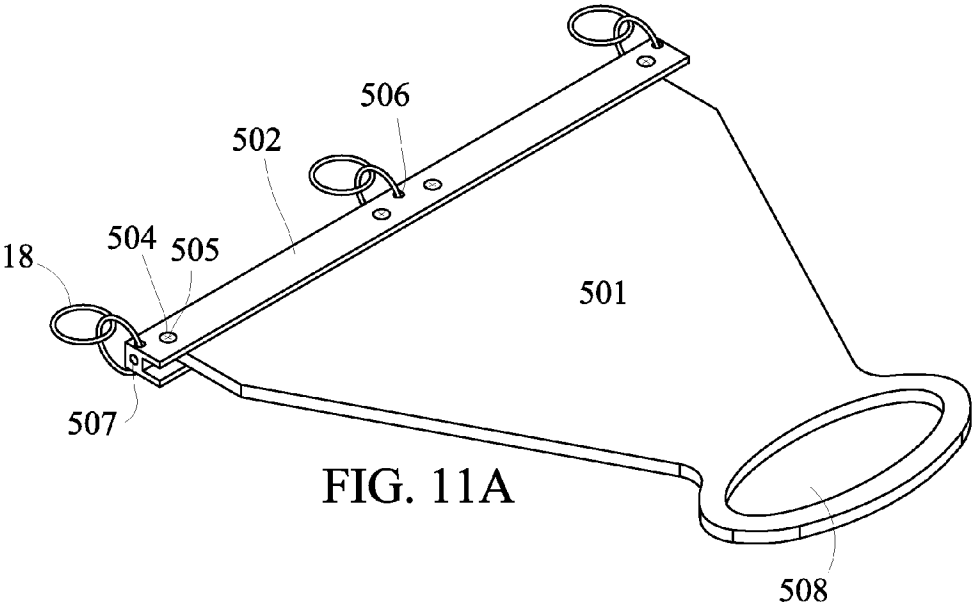
FIGS. 11A and 11B show views of a possible design for an extraction mechanism designed for a single panel with three connection points.
Figure 11B:
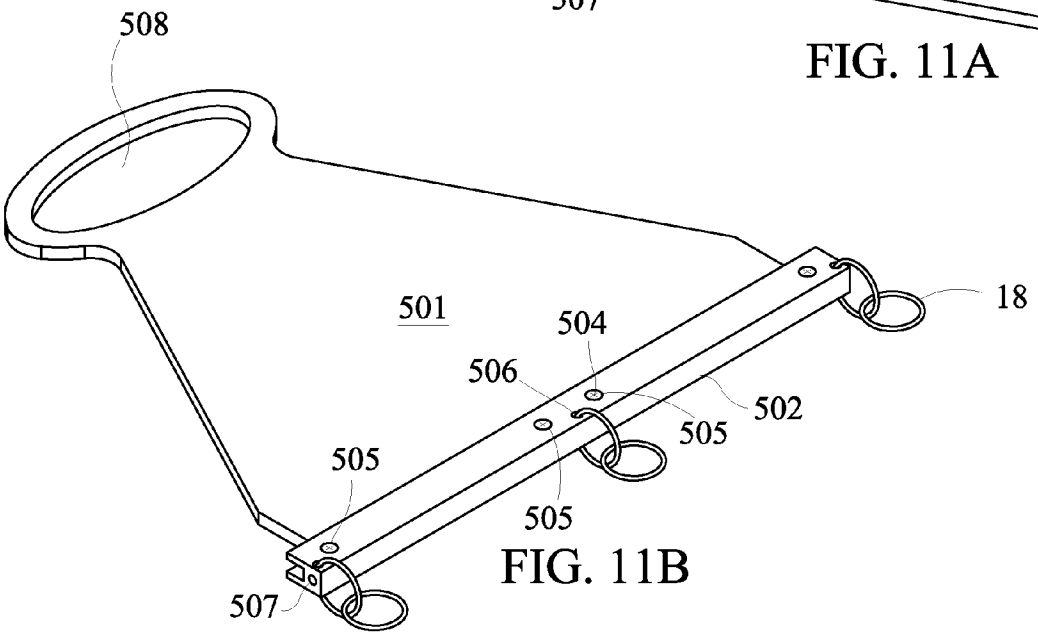

FIGS. 11A and 11B show two views of a possible design for an extraction mechanism configured for a single panel with three connection points. The body 501 with a handle-like grip 508 is fitted with a reinforcement member 502 that is connected to the body 501 through holes 504 using machine screws 505. The body can be constructed of any sturdy material that will support the forces exerted during extraction. Preferably, the reinforcement member 502 is constructed of a metal like aluminum or stainless steel. Holes 506 along the outboard end of the reinforcement member 502 disposed to correspond to the attachment of the panels serve as connection points for the pins (not shown). Although the pins may be connected directly to the reinforcement arm 502, preferable other hardware such as rings 18 or lanyards or cables (not shown) are used to make this connection. At either end of the reinforcement arm is a hole 507 to accommodate extension members (508 in FIG. 12) so the extraction mechanism can be extended to accommodate additional panels.

Figure 12:
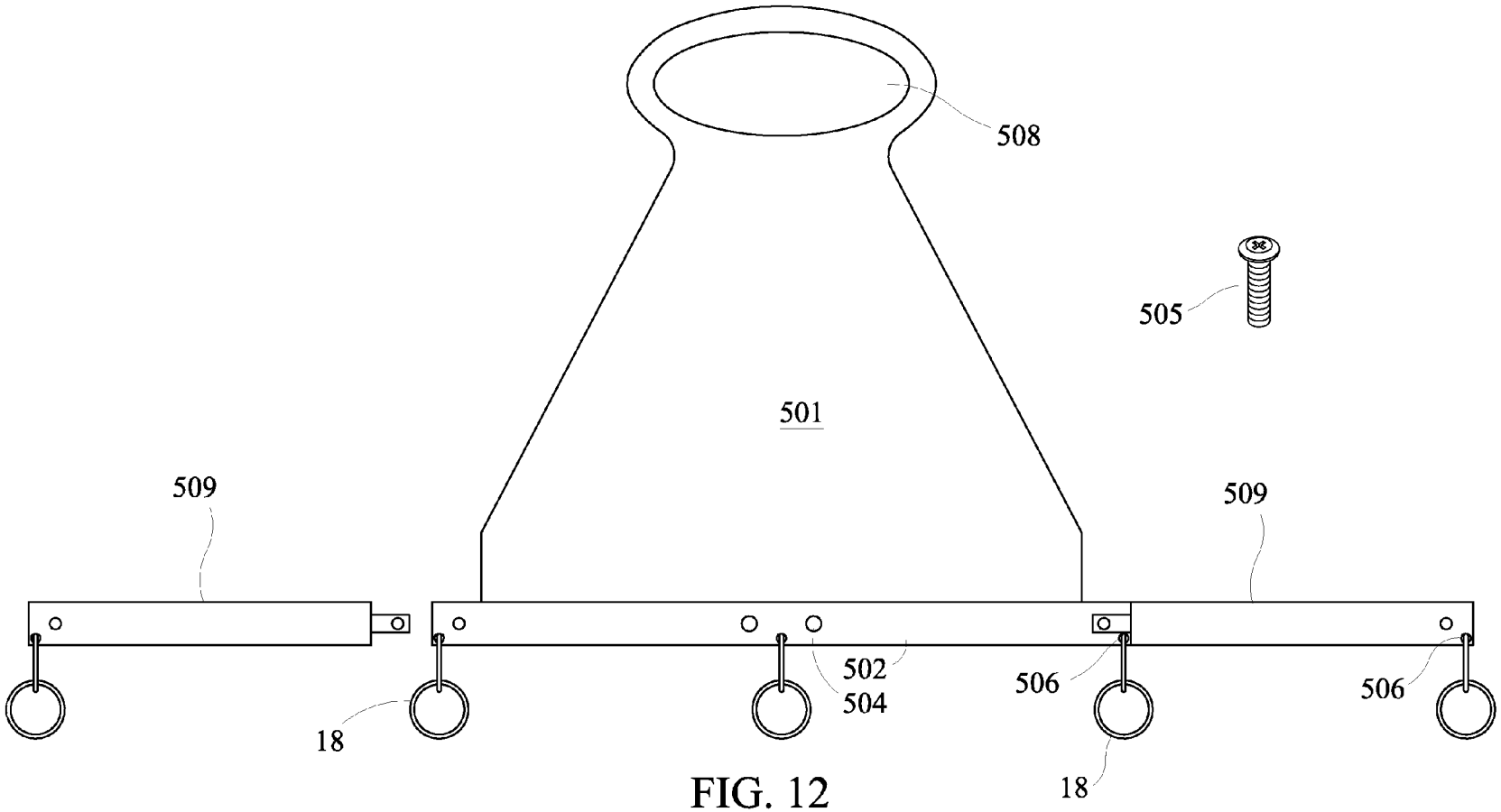
FIG. 12 shows a view of a possible design for an extraction mechanism with extension members that allow it to be extended to accommodate two panels with five connection points, and illustrate how the extension members fit in with and connect to the single panel extraction mechanism of FIGS. 11A and 11B. Note that each extension arm can accommodate other extension arms, thereby allowing a single extraction mechanism to be adapted to accommodate various multiples of panels and connection points.

FIG. 12 shows the extraction mechanism of FIGS. 11A and 11B with an extension member 509 on each end, which extension members are designed to be attached to the reinforcement member 502 with machine screws 504. Note that each extension member 509 can accommodate other extension members, thereby allowing a single extraction mechanism to be adapted to accommodate various multiples of panels and connection points.

It should be noted that the extraction mechanism shown in these FIGS. 11A, 11B and 12 accommodates a single panel with possible expansion to two, three or more panels. While typically, an installation will comprise two or more soft panels, this single panel design of an extraction with extension members is preferred because it is more compact and convenient for shipping purposes. However, a single extraction mechanism can be constructed to accommodate two or more panels without the need for expansion.

Finally, the extraction mechanism shown in these FIGS. 11A, 11B and 12 is not intended to be limiting, but is intended to illustrate the features which are desirable in an extraction mechanism. It should also be noted that the use of an extraction mechanism, although desirable is optional, as the pins can be extracted in a variety of ways including manually.

It is noted that the scope of the invention is defined by the claims, and the embodiments are provided by way of example and not by way of limitation. The various embodiments and variations may be used in consistent combinations and subcombinations, without departing from the scope hereof.

What is claimed is:

1. A system for attaching a first object to a second object such that the first object can be quick released from the second object, comprising:

(a) a stepped bolt structure, comprising a shaft having an outer diameter, and a threaded stepped down portion having an outer diameter smaller than the outer diameter of the shaft, said stepped bolt structure further having a hole through the shaft along a non-parallel path with respect to an axis of the shaft;

(b) a receiving structure for receiving the threaded stepped down portion of said stepped bolt structure;

(c) a nut, having a thread corresponding to the thread on said sleeve, wherein the sleeve is configured to pass through a hole in the first object and engage with the nut, to thereby retain the first object;

(d) a sleeve, having an inner diameter larger than the outer diameter of said shaft and being configured to pass over the shaft of the stepped bolt structure, said sleeve being threaded on at least a portion of an outer diameter thereof and having a hole corresponding to said hole in said shaft, and being configured to permit a in to extend through the hole in the sleeve, the hole in the spacer, and the hole in the shaft, said sleeve has a length and at least two different outer diameters, the largest of the two outer diameters being disposed on a first end having the hole in the sleeve and being larger than an inner diameter of said spacer; wherein a depth along said sleeve from a second end to a shoulder at a transition between the two different outer diameters is greater than the depth of said spacer;

(e) a spacer, configured to be disposed between the first object and the second object, said spacer having a spacer hole having an inner diameter larger than the outer diameter of the sleeve and being configured to freely permit insertion of the sleeve over the shaft of the stepped bolt structure, and further having at least one hole cross-bored through the spacer hole corresponding to the spacer hole and the hole through the shaft of the stepped bolt structure; and (f) a pin, sized to be concurrently inserted through the cross-bored hole in the spacer, the hole in the shaft, and the corresponding hole in the sleeve;

wherein:

said receiving structure is disposed in the second object and the stepped bolt is connected thereto;

said sleeve and said spacer are placed over the shaft of said stepped bolt and are connected together with said pin;

the first object has a hole of sufficient diameter and disposed in position to allow the first object to be placed over the sleeve with clearance, said hole adapted to serve as an attachment point for the first object;

the second object has a hole having a diameter larger than the outer diameter of the thread of the stepped down portion of said stepped bolt, and smaller than an outer dimension of said nut, to thereby retain the stepped bolt and said nut;

the first object is placed through the sleeve and fastened in place with the nut, thereby being attached to the second object; and the pin is configured to be retained in the spacer, sleeve and the shaft when subject to tensile forces directly separating the first object and the second object, and the pin is configured to be readily extracted from the spacer, sleeve and the shaft to thereby quick-release the first object from the second object by application of a force along the axis of the shaft, to therefore separate the shaft and the sleeve.

2. The system of claim 1, wherein the first object is at least one of a hurricane panel and a track, and the second object is a structure.

3. The system of claim 2 wherein each of said stepped bot and said spacer have at least two corresponding sets of holes, to thereby provide two object retaining configurations with respective different depths.

4. The system of claim 2, wherein the structure comprises a female hardware component comprising an anchor, configured to receive said outer diameter of the thread on the stepped down portion of said stepped bolt.

5. The system of claim 2, wherein the hurricane panel is connected to the structure proximate an opening in the structure.

6. The system of claim 1, wherein a plurality of pins are connected to a common extraction mechanism, wherein an action by the common extraction mechanism releases a plurality of pins concurrently.

7. The system of claim 1, wherein said nut comprises a wing nut.

8. The system of claim 1, further comprising a washer adapted to be disposed between said nut and the first object.

9. The system of claim 1, wherein said largest of the at least two different outer diameters is larger than an inner diameter of the hole in the first object, such that said first object is supported by said shoulder of said sleeve.

10. The system of claim 1, further comprising a washer having an outside diameter larger than the largest of the two outer diameters and an inside diameter smaller than the largest of the two outer diameters and larger than the next largest of the at least two outer diameters, configured to be disposed on said sleeve prior to placement of the first object over said sleeve, such that said washer is supported by said shoulder, and the first object is supported by said washer.

11. The system of claim 10, wherein:

said sleeve has three outer diameters, with the second largest outer diameter disposed between the largest outer diameter and the smallest outer diameter;

an axial distance along the sleeve corresponding to said second diameter corresponds to the depth of a washer;

the inside diameter of said washer is sized such that said washer can be pressed on to the second diameter of said sleeve; and said washer is pressed onto said second diameter of said sleeve, and said washer is adapted to provide support for said first object.

12. The system of claim 1, wherein a plurality of stepped bolt structures, sleeves, spacers, and pins are provided for attaching the first object to the second object, configured such that:

an end of each sleeve extends beyond the respective shaft, and a second hole sized to accommodate a second pin is disposed in the extended end of each sleeve;

a second pin is inserted into each second hole;

the second pins are each mechanically connected through a flexible structure to the first object and the second object, wherein, when the second pins are extracted, the released sleeves are held together, thus preventing the released sleeves and the nuts attached to said sleeves from scattering.

13. A method for attaching at least one of a first object to a second object such that the first object can be quick released from the second object; said method using at least one system according to claim 1, comprising:

engaging the nut and the thread on the stepped down portion of said bolt structure to retain the first object;

inserting the pin concurrently through the holes in the shaft and the spacer;

mating the second object to the spacer; and quick releasing the first object from the second object by removing the pin from the holes in the shaft and the spacer.

14. The method of claim 13, wherein the first object is at least one of a hurricane panel and a track, and the second object is a structure.

15. The method of claim 13, wherein the pin is connected to an extraction mechanism by a hardware component.

16. The method of claim 13, wherein the system further comprises a washer disposed between the nut and the first object.

17. The system of claim 1, wherein the pin has a hole across its axis which is linked to a cable, wherein the cable is configured to apply a tensile force to remove the pin from the holes in the spacer and the shaft.

* * * * *